US008287080B2

(12) United States Patent
Endo

(10) Patent No.: US 8,287,080 B2
(45) Date of Patent: Oct. 16, 2012

(54) LIQUID EJECTION APPARATUS, LIQUID EJECTION SYSTEM, AND LIQUID EJECTION METHOD

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 387 days.

(21) Appl. No.: 12/725,293

(22) Filed: Mar. 16, 2010

(65) Prior Publication Data

US 2010/0171785 A1 Jul. 8, 2010

Related U.S. Application Data

(63) Continuation of application No. 12/024,840, filed on Feb. 1, 2008, now Pat. No. 7,708,366, which is a continuation of application No. 10/548,184, filed as application No. PCT/JP2004/005329 on Apr. 14, 2004, now Pat. No. 7,401,881.

(30) Foreign Application Priority Data

Apr. 15, 2003 (JP) ..... 2003-110842

(51) Int. Cl.
*B41J 29/393* (2006.01)

(52) U.S. Cl. ..... 347/19; 347/14

(58) Field of Classification Search ..... 347/14, 347/10, 101, 105, 12, 15
See application file for complete search history.

(56) References Cited

U.S. PATENT DOCUMENTS

| | | | | |
|---|---|---|---|---|
| 5,997,129 | A | 12/1999 | Matsuhashi | |
| 6,109,745 | A | 8/2000 | Wen | |
| 6,247,787 | B1 | 6/2001 | Giere et al. | |
| 6,375,307 | B1 | 4/2002 | Vinals et al. | |
| 6,409,305 | B1 | 6/2002 | Elgee et al. | |
| 6,746,101 | B2 | 6/2004 | Otsuki | |
| 6,935,715 | B2 | 8/2005 | Bates et al. | |
| 7,165,827 | B2 | 1/2007 | Otsuki | |
| 7,367,732 | B2 * | 5/2008 | Koga et al. | 400/624 |
| 7,393,078 | B2 | 7/2008 | Yazawa et al. | |
| 7,431,423 | B2 | 10/2008 | Otsuki | |
| 7,562,955 | B2 | 7/2009 | Otsuki | |
| 7,585,042 | B2 * | 9/2009 | Otsuki | 347/19 |
| 7,699,460 | B2 * | 4/2010 | Yokoi | 347/104 |
| 2009/0033697 | A1 | 2/2009 | Otsuki | |

FOREIGN PATENT DOCUMENTS

| | | | |
|---|---|---|---|
| EP | 1193075 | A2 | 3/2002 |
| JP | 8-169155 | A | 7/1996 |
| JP | 11-291470 | A | 10/1999 |
| JP | 2001-96874 | A | 4/2001 |
| JP | 2002-103587 | A | 4/2002 |
| JP | 2003-53953 | A | 2/2003 |

* cited by examiner

*Primary Examiner* — Lamson Nguyen

(57) ABSTRACT

A liquid ejection apparatus, a liquid ejection system, and a liquid ejection method are achieved which allow starting and ending positions for ejecting liquid to be set appropriately. A controller is provided which executes position determination control for determining at least one of the starting position and the ending position for ejecting liquid from a moving ejection head onto a medium that is fed by a feed mechanism, wherein the position determination control by the controller differs for when ejecting the liquid from the ejection head to a region within a predetermined range from a front edge or a rear edge, in a feed direction, of the medium, and for when ejecting the liquid from the ejection head to a central region, in the feed direction, of the medium.

12 Claims, 13 Drawing Sheets

LIQUID EJECTION APPARATUS, LIQUID EJECTION SYSTEM, AND LIQUID EJECTION METHOD

CROSS-REFERENCE TO RELATED APPLICATIONS

This is a Continuation of application Ser. No. 12/024,840 filed Feb. 1, 2008, which is a continuation of application Ser. No. 10/548,184 filed Sep. 7, 2005, which is a 371 of International Application No. PCT/JP2004/005329 filed Apr. 14, 2004. The entire disclosures of the prior applications are hereby incorporated by reference.

TECHNICAL FIELD

The present invention relates to liquid ejection apparatuses, liquid ejection systems, and liquid ejection methods.

BACKGROUND ART

Color inkjet printers are already well known as typical liquid ejection apparatuses. Color inkjet printers are provided with a print head, which is an example of an inkjet-type ejection head, for ejecting ink, which is an example of a liquid, from nozzles, and are configured to record images and text, for example, by ejecting ink onto print paper, which is an example of a medium.

The print head is supported by a carriage such that the nozzle face in which the nozzles are formed is in opposition to the print paper, and moves (performs "main scan") in the width direction of the print paper along a guide member, ejecting ink in synchronization with this main scan.

Moreover, color jet printers that allow so-called borderless printing, in which the entire surface of the print paper is printed on, have become popular in recent years because, among other things, they allow output results of images like photographs to be obtained. Borderless printing for example allows printing to be carried out by ejecting ink without leaving borders at the four edges of the print paper.

However, since printing is performed over the entire surface of the print paper with borderless printing, it is important to ensure that there are no margin portions at the edges of the printed print paper. In order to achieve this, it is effective to adopt an approach of: preparing print data that is slightly larger than the printing, or in other words, print data that is provided with a certain margin compared to the size of the print paper; and printing on the print paper according to this print data, in order to give due consideration to the possibility that the 'print paper may be fed at an angle (fed in a skewed state).

Further, in order to mitigate the problem brought about by the above-mentioned approach in that ink is wasted by printing in regions outside the print paper, an effective measure is to detect the position of an edge of the print paper using a sensor and vary a starting position and/or an ending position for ejecting ink according to the position of the detected edge.

However, while executing such a measure, it is possible that a situation may occur in which detection of the positions of the left and right edges becomes shifted due to a detection error of the sensor when the sensor is near the top and bottom edges of the print paper. This situation is described using FIG. 16 and FIG. 17. FIG. 16 is a schematic diagram showing the positional relationship between the print paper and the illumination spot of the left-and-right-edge detection sensor. FIG. 17 is an explanatory diagram illustrating the shift in the detected positions of the left and right edges depending on the position of the illumination spot of the left-and-right-edge detection sensor.

According to FIG. 16, the illumination spot of the edge detection sensor (here, for detection of the lateral edges) on a print paper P moves in a main scanning direction while causing changes in the amount of light received by being blocked by the edge of the print paper P, and thereby the edge is detected by referencing a set value (i.e., a threshold value).

However, as indicated by Spot Position 1 and Spot Position 2, a difference in the area on the print paper P, which blocks the spot, occurs even at similar positions at the left and right edges in the main scanning direction (in this example, the area of Spot Position 2 is half the area of Spot Position 1). In other words, when detecting the left and right edges at the top or bottom edge portions of the print paper as shown by Spot Position 2, it is necessary for the spot to move further in the main scanning direction (inward into the print paper) in order to attain a light-blocked area in the print paper, which is similar to that of Spot Position 1, and reach the threshold value. In this example, the spot diameter attains the same light-blocked area (i.e., threshold value) at the position (shown by the dotted circle) which is inward of the print paper P.

As shown in more detail in FIG. 17, at Spot Position 1, or in other words, at positions which do not include the top or bottom edges of the print paper P in the paper feed direction of the print paper P, the amount of light received by the edge detection sensor reaches the judgment threshold value when the illumination spot reaches edge position PE in the main scanning direction of the print paper P. However, at Spot Position 2, or in other words, at positions which include the top or bottom edges of the print paper P in the paper feed direction of the print paper P, the amount of light received by the edge detection sensor does not reach the judgment threshold value described above even when the illumination spot reaches the edge position PE in the main scanning direction of the print paper P, as described above. As the edge detection sensor moves further in the main scanning direction, or in other words, as the illumination spot moves further in the main scanning direction and the amount of light received by the edge detection sensor increases, the amount of light received by the edge detection sensor at a position C, which is much inward from the print paper edge PE, reaches the judgment threshold value, and this position is mistakenly identified as the edge position of the print paper P.

Due to this, the left and right edges are mistakenly detected further inward of the print paper P when the sensor is near the top or bottom edges of the print paper, and the starting position and ending position for ink to be ejected are determined based on these misdetected positions of the left and right edges; therefore, no ink is ejected in these portions, and margins are formed in these portions.

Situations may also arise in which the positions of the left and right edges of the print paper are not detected due to a detection error in the sensor due to the position of the print paper, or some other reason.

In such situations, there is the possibility that a margin might mistakenly be created in the print paper if the starting position and the ending position for ejecting ink in the next main scan are determined simply by using information about the positions of the left and right edges detected during the immediately preceding main scan, without changing the procedure for determining the starting position and the ending position. This problem is likely to occur especially in cases where the print paper is supplied at an angle (skewed).

The present invention was arrived at in light of the foregoing issues, and it is an object thereof to achieve a liquid ejection apparatus, a liquid ejection system, and a liquid ejection method that can appropriately set starting positions and ending positions for ejecting liquid.

DISCLOSURE OF INVENTION

A primary aspect of the present invention is a liquid ejection apparatus for ejecting liquid, comprising:

a movable ejection head for ejecting liquid;

a feed mechanism for feeding a medium;

a sensor for detecting a position of an edge of the medium; and a controller for executing position determination control for determining at least one of a starting position and an ending position for ejecting the liquid from the moving ejection head onto the medium that is fed by the feed mechanism, wherein the position determination control by the controller differs for when ejecting the liquid from the ejection head to a region within a predetermined range from a front edge or a rear edge, in a feed direction, of the medium, and for when ejecting the liquid from the ejection head to a central region, in the feed direction, of the medium.

Another primary aspect of the present invention is a liquid ejection system, comprising:

(a) a computer unit; and (b) a liquid ejection apparatus for ejecting liquid, the liquid ejection apparatus being provided with:

a movable ejection head for ejecting liquid;

a feed mechanism for feeding a medium;

a sensor for detecting a position of an edge of the medium; and a controller for executing position determination control for determining at least one of a starting position and an ending position for ejecting the liquid from the moving ejection head onto the medium that is fed by the feed mechanism;

wherein the position determination control by the controller differs for when ejecting the liquid from the ejection head to a region within a predetermined range from a front edge or a rear edge, in a feed direction, of the medium, and for when ejecting the liquid from the ejection head to a central region, in the feed direction, of the medium.

Another primary aspect of the present invention is a liquid ejection method for ejecting liquid, comprising:

a step of feeding a medium;

a step of executing position determination control for determining at least one of a starting position and an ending position for ejecting liquid from a moving ejection head onto the medium that is fed;

a step of starting ejection of the liquid from the ejection head at the starting position; and a step of ending ejection of the liquid from the ejection head at the ending position;

wherein the position determination control differs for when ejecting the liquid from the ejection head to a region within a predetermined range from a front edge or a rear edge, in a feed direction, of the medium, and for when ejecting the liquid from the ejection head to a central region, in the feed direction, of the medium.

Other features of the present invention will become clear through the present specification with reference to the accompanying drawings.

Figure 1:
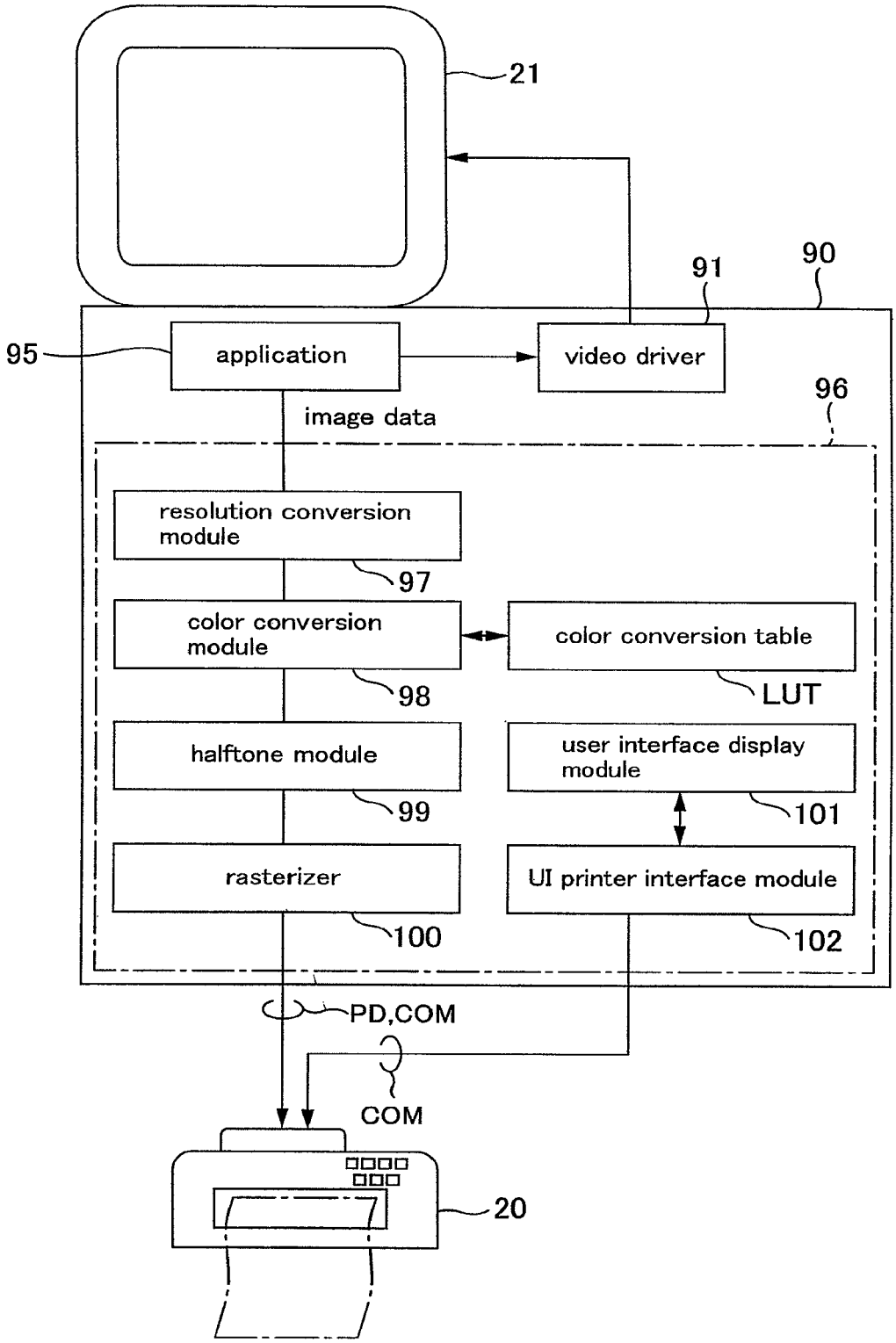
FIG. 1 is a block diagram showing the configuration of a printing system serving as an example of the present invention.

A legend of the main reference numerals used in the drawings is shown below.

11 . . . linear encoder/12 . . . linear encoder code plate/13 . . . rotary encoder/14 . . . rotary encoder code plate/20 . . . color ink jet printer/21 . . . CRT/22 . . . paper stacker/24 . . . paper feed roller/25 . . . pulley/26 . . . platen/28 . . . carriage/29 . . . reflective optical sensor/30 . . . carriage motor/31 . . . paper feed motor/32 . . . pull belt/33 . . . paper end detection device/34 . . . guide rail/36 . . . print head/38 . . . light-emitting section/40 . . . light-receiving section/50 . . . buffer memory/52 . . . image buffer/54 . . . system controller/56 . . . main memory/58 . . . EEPROM/61 . . . main-scan drive circuit/62 . . . sub-scan drive circuit/63 . . . head drive circuit/65 . . . reflective optical sensor control circuit/66 . . . electric signal measuring section/90 . . . computer/91 . . . video driver/95 . . . application program/96 . . . printer driver/97 . . . resolution conversion module/98 . . . color conversion module/99 . . . halftone module/100 . . . rasterizer/101 . . . user interface display module/102 . . . UI printer interface module/1000 computer system/1102 . . . computer unit/1104 . . . display device/1106 . . . printer/1108 . . . input device/1108A . . . keyboard/1108B . . . mouse/1110 . . . reading device/1110A . . . flexible disk drive device/1110B . . . CD-ROM drive device/1202 . . . internal memory/1204 . . . hard disk drive unit/P . . . print paper/PS . . . predetermined range

BEST MODE FOR CARRYING OUT THE INVENTION

At least the following matters will be made clear by the present specification and the accompanying drawings.

A liquid ejection apparatus for ejecting liquid, comprises:

a movable ejection head for ejecting liquid;

a feed mechanism for feeding a medium;

a sensor for detecting a position of an edge of the medium; and a controller for executing position determination control for determining at least one of a starting position and an ending position for ejecting the liquid from the moving ejection head onto the medium that is fed by the feed mechanism, wherein the position determination control by the controller differs for when ejecting the liquid from the ejection head to a region within a predetermined range from a front edge or a rear edge, in a feed direction, of the medium, and for when ejecting the liquid from the ejection head to a central region, in the feed direction, of the medium.

With this liquid ejection apparatus, it is possible to realize a liquid ejection apparatus which allows starting and ending positions for ejecting liquid to be set appropriately.

Further, the sensor may be capable of moving together with the ejection head; when ejecting the liquid from the ejection head to the central region, in the feed direction, of the medium, the controller may execute sensor-based position determination control that determines at least one of the starting position and the ending position for ejecting the liquid from the ejection head for a next movement, based on a position of the edge detected by the sensor during the current movement; and when ejecting the liquid from the ejection head to the region within the predetermined range from the front edge or the rear edge, in the feed direction, of the medium, the controller may not have to execute the sensor-based position determination control.

With this liquid ejection apparatus, it is possible to avoid erroneous creation of a margin on the medium, by not executing sensor-based position determination control when ejecting liquid to a region within a predetermined range from a front edge or a rear edge of the medium in the feed direction.

Further, the sensor may be capable of moving together with the ejection head; when ejecting the liquid from the ejection head to the central region, in the feed direction, of the medium, the controller may execute sensor-based position determination control that determines at least one of the starting position and the ending position for ejecting the liquid from the ejection head for a next movement, based on a position of the edge detected by the sensor during the current movement; and when ejecting the liquid from the ejection head to the region within the predetermined range from the front edge or the rear edge, in the feed direction, of the medium, the controller may set the starting position or the ending position to a position determined in advance.

In this way, it is possible to determine the appropriate starting position or ending position more easily and more accurately.

Further, when the sensor-based position determination control is not executed, the controller may determine the starting position or the ending position based on a position of the edge detected when the position determination control was executed. In this way, it is possible to determine the starting position or the ending position based on minimum information regarding the position of the edge detected in the past.

Further, when the sensor-based position determination control is not executed, the controller may determine the starting position or the ending position based on a plurality of positions of the edges detected when the position determination control was executed, and an amount that the medium has been fed from when the position of the edge was detected. In this way, it is possible to determine the appropriate starting position or ending position more accurately.

Further, when the sensor-based position determination control is not executed, the controller may determine the starting position or the ending position based on a position of a single edge detected when the position determination control was executed, an amount that the medium has been fed from when the position of the edge was detected, and a maximum predicted skew angle of the medium. In this way, it is possible to determine the appropriate starting position or ending position more accurately.

Further, when the sensor-based position determination control is not executed, the controller may determine the starting position or the ending position based on a position of a single edge detected when the position determination control was executed, and a width of the medium. In this way, it is possible to determine the appropriate starting position or ending position more accurately.

Further, the liquid may be ejected with respect to an entire surface of the medium. When ejecting liquid with respect to an entire surface of the medium, the advantages of the above procedures for ejecting ink also to the edges of the medium become even more pronounced.

Further, the sensor may be provided with a light-emitting section for emitting light and a light-receiving sensor for receiving the light that moves in a main scanning direction in accordance with the movement of the light-emitting section in the main scanning direction; and a position of the edge may be detected based on a change in an output value of the light-receiving sensor due to the light that is emitted from the light-emitting section and that is moving in the main scanning direction being blocked by the edge. With this, it is possible to detect the position of the edge more easily.

Further, the sensor may be provided to a movable moving member that is provided with the ejection head. In this way, it is possible to share the moving mechanism for the moving member and the sensor.

Further, while the moving member is being moved in a main scanning direction: a position of the edge may be detected based on a change in an output value of the light-receiving sensor due to the light that is emitted from the light-emitting means and that is moving in the main scanning direction being blocked by the edge; and the liquid may be ejected from the ejection head onto the medium. In this way, it is possible to realize efficient operation of the liquid ejection apparatus.

Further, the liquid may be ink; and the liquid ejection apparatus may be an apparatus for printing on a medium to be printed, which is the medium, by ejecting ink from the ejection head. In this case, it is possible to realize a printing apparatus which accomplishes the effects described above.

Further, the ejection head may eject ink with respect to an entire surface of the medium; the sensor may be capable of moving together with the ejection head and may be provided with a light-emitting section for emitting light and a light-receiving sensor for receiving the light that moves in a main scanning direction in accordance with the movement of the light-emitting section in the main scanning direction; the controller may detect a position of the edge based on a change in an output value of the light-receiving sensor due to the light that is emitted from the light-emitting section and that is moving in the main scanning direction being blocked by the edge; when ejecting the ink from the ejection head to the central region, in the feed direction, of the medium, the controller may execute sensor-based position determination control that determines at least one of the starting position and the ending position for ejecting the ink from the ejection head for a next movement, based on a position of the edge detected by the sensor during the current movement; and when ejecting the ink from the ejection head to the region within the predetermined range from the front edge or the rear edge, in the feed direction, of the medium, the controller may set the starting position or the ending position to a position determined in advance.

It is also possible to realize a liquid ejection system, comprising: (a) a computer unit; and (b) a liquid ejection apparatus for ejecting liquid, the liquid ejection apparatus being provided with: a movable ejection head for ejecting liquid; a feed mechanism for feeding a medium; a sensor for detecting a position of an edge of the medium; and a controller for executing position determination control for determining at least one of a starting position and an ending position for ejecting the liquid from the moving ejection head onto the medium that is fed by the feed mechanism; wherein the position determination control by the controller differs for when ejecting the liquid from the ejection head to a region within a predetermined range from a front edge or a rear edge, in a feed direction, of the medium, and for when ejecting the liquid from the ejection head to a central region, in the feed direction, of the medium.

It is also possible to realize a liquid ejection method for ejecting liquid, comprising: a step of feeding a medium; a step of executing position determination control for determining at least one of a starting position and an ending position for ejecting liquid from a moving ejection head onto the medium that is fed; a step of starting ejection of the liquid from the ejection head at the starting position; and a step of ending ejection of the liquid from the ejection head at the ending position; wherein the position determination control differs for when ejecting the liquid from the ejection head to a region within a predetermined range from a front edge or a rear edge, in a feed direction, of the medium, and for when ejecting the liquid from the ejection head to a central region, in the feed direction, of the medium.

Example of the Overall Configuration of the Apparatus

FIG. 1 is a block diagram showing the configuration of a printing system serving as an example of a liquid ejection system. The printing system is provided with a computer 90 and a color inkjet printer 20, which is an example of a liquid ejection apparatus. It should be noted that the printing system including the color inkjet printer 20 and the computer 90 can also be broadly referred to as a "liquid ejection apparatus." Also, although not shown in the drawing, a computer system is made up of the computer 90, the color inkjet printer 20, a display device such as a CRT 21 or a liquid crystal display device, an input device such as a keyboard or a mouse, and a drive device such as a flexible drive device or a CD-ROM drive device.

In the computer 90, an application program 95 operates under a predetermined operating system. The operating system includes a video driver 91 and a printer driver 96, and from the application program 95, print data PD for transfer to the color inkjet printer 20 are output via these drivers. The application program 95, which for example retouches images, carries out a desired process with respect to an image to be processed, and displays images on the CRT 21 via the video driver 91.

When the application program 95 issues a print instruction, the printer driver 96 of the computer 90 receives image data from the application program 95 and converts it into print data PD to be supplied to the color inkjet printer 20. The printer driver 96 is internally provided with a resolution conversion module 97, a color conversion module 98, a halftone module 99, a rasterizer 100, a user interface display module 101, a UI printer interface module 102, and a color conversion lookup table LUT.

The resolution conversion module 97 performs the function of converting the resolution of color image data formed by the application program 95 to the print resolution. The image data that is thus converted in resolution is still image information composed of the three color components RGB. The color conversion module 98 references the color conversion lookup table LUT as it converts the RGB image data for each pixel into multi-gradation data of a plurality of ink colors that can be used by the color inkjet printer 20.

The color-converted multi-gradation data has 256 gradation values, for example. These data is subjected to so-called "halftoning" by the halftone module 99, creating halftone image data. The halftone image data is rearranged by the rasterizer 100 into the data order in which it is to be transferred to the color inkjet printer 20, and is output as the final print data PD. The print data PD includes raster data indicating how dots are formed during each main scan and data indicating the sub-scan feed amount.

The user interface display module 101 has a function for displaying various types of user interface windows related to printing and a function for receiving user input through those windows.

The UI printer interface module 102 has a function for acting as an interface between the user interface (UI) and the color inkjet printer. It interprets instructions given by the user through the user interface and transmits various commands COM to the color inkjet printer, and conversely, interprets the commands COM received from the color inkjet printer and performs various displays on the user interface.

It should be noted that the printer driver 96 executes, for example, a function for sending and receiving various types of commands COM and a function for supplying print data PD to the color inkjet printer 20. A program for achieving the functions of the printer driver 96 is supplied in a format in which it is stored on a computer-readable storage medium. Various types of computer-readable media can be used as a storage medium, including flexible disks, CD-ROMs, magneto-optical disks, IC cards, ROM cartridges, punch cards, printed material on which a code such as a barcode is printed, storage devices (memories such as a RAM or ROM) inside a computer, and storage devices outside a computer. Also, such a computer program can be downloaded onto the computer 90 via the Internet.

Figure 2:
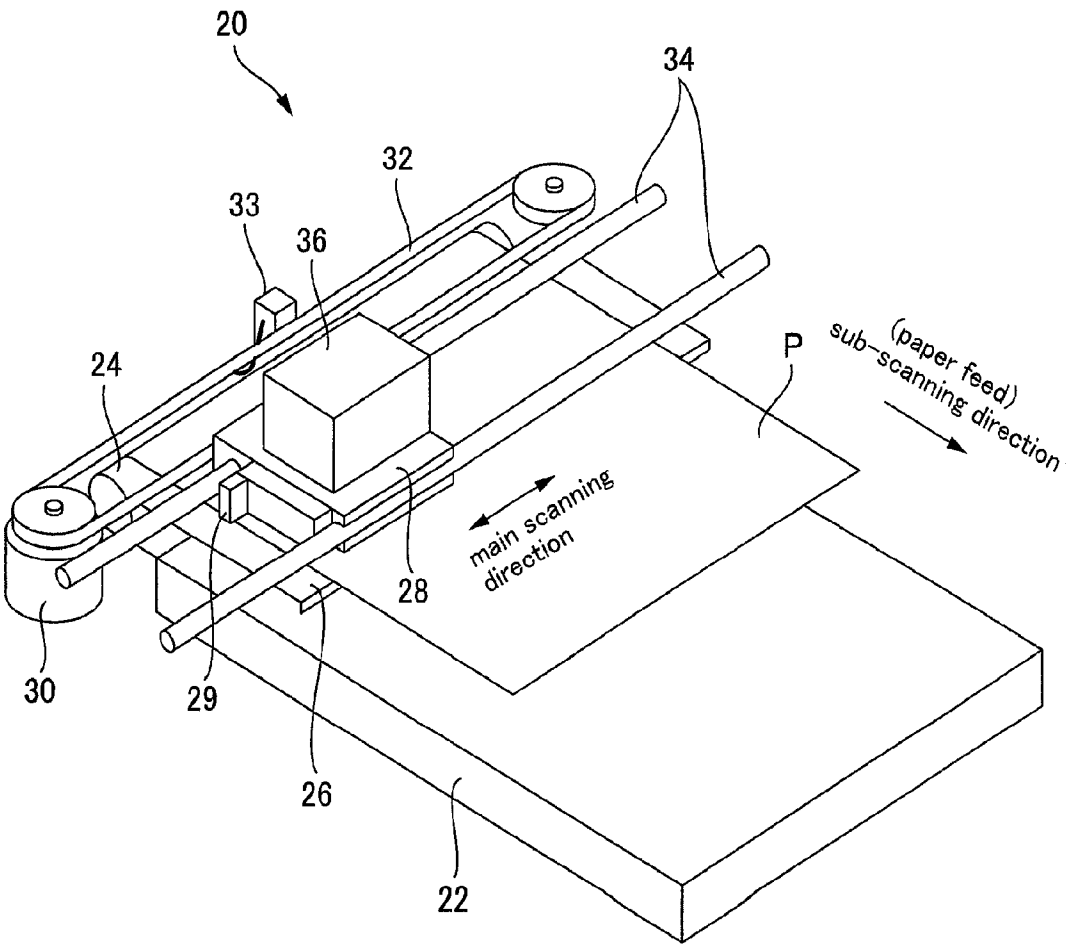
FIG. 2 is a block diagram that shows an example of a primary configuration of a color inkjet printer 20.

FIG. 2 is a perspective view that schematically shows an example of a primary configuration of a color inkjet printer 20. The color inkjet printer 20 is provided with a paper stacker 22, a paper feed roller 24 driven by a step motor that is not shown, a paper end detection device 33 for detecting supply of a print paper P, a platen 26, a carriage 28 serving as an example of a movable moving member provided with a print head for forming dots, a carriage motor 30, a pull belt 32 that is driven by the carriage motor 30, and a guide rail 34 for the carriage 28. A print head 36, which is an example of an ejection head provided with numerous nozzles, and a reflective optical sensor 29, which is an example of a detecting means that will be described in detail later, are mounted onto the carriage 28.

The print paper P is rolled from the paper stacker 22 by the paper feed roller 24 and fed in a paper feed direction (hereinafter also referred to as the sub-scanning direction) over the surface of the platen 26. The carriage 28 is drawn by the draw belt 32, which is driven by the carriage motor 30, and moved in the main scanning direction along the guide rail 34. It should be noted that as shown in the diagram, the main scanning direction refers to the two directions perpendicular to the sub-scanning direction. The paper feed roller 24 is also used to carry out the paper-supply operation for supplying the print paper P to the color inkjet printer 20 and the paper discharge operation for discharging the print paper P from the color inkjet printer 20.

Example Configuration of the Reflective Optical Sensor

Figure 3:
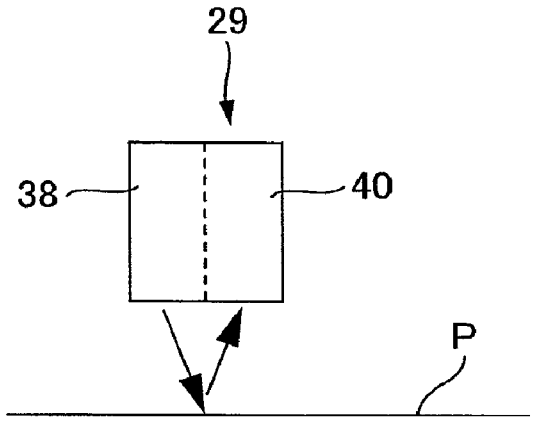
FIG. 3 is a schematic diagram illustrating an example of a reflective optical sensor 29.

FIG. 3 is a schematic diagram illustrating an example of a reflective optical sensor 29. The reflective optical sensor 29 is attached to the carriage 28, and has a light-emitting section 38, which is for example made of a light-emitting diode and is an example of a light-emitting means, and a light-receiving section 40, which is for example made of a phototransistor and is an example of a light-receiving sensor. The light that is emitted from the light-emitting section 38, that is, the incident light, is reflected by print paper P or by the platen 26 if there is no print paper P in the direction in which the light is emitted, and the reflected light is received by the light-receiving section 40 and the intensity of the electric signal is measured.

It should be noted that in the above description, as shown in the drawing, the light-emitting section 38 and the light-receiving section 40 are configured in a single unit as a device that serves as the reflective optical sensor 29, although they may each constitute separate devices, such as a light-emitting device and a light-receiving device.

Also, in the above description, in order to obtain the strength of the reflected light that is received, the intensity of the electric signal is measured after the reflected light is converted into an electric signal, although there is no limitation to this; it is sufficient if the output value of the light-receiving sensor, which corresponds to the strength of the reflected light that is received, can be measured.

Example Configuration of the Carriage Area

Figure 4:
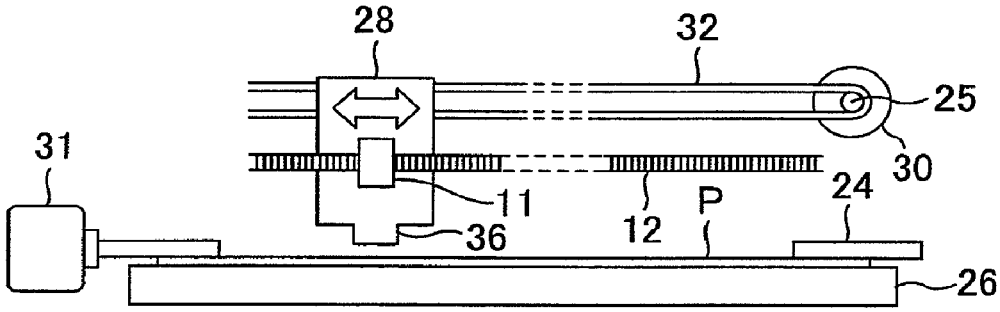
FIG. 4 is a diagram showing the configuration around a carriage 28 of the inkjet printer.

The configuration around the carriage is described next. FIG. 4 is a diagram showing the configuration around the carriage 28 of the inkjet printer.

The inkjet printer shown in FIG. 4 is provided with: a paper feed motor (hereinafter also referred to as "PF motor") 31, which is for feeding paper and which is as an example of the feed mechanism; a carriage 28 to which the print head 36 for ejecting ink, which is an example of a liquid, onto the print paper P is fastened and which is driven in the main scanning direction; the carriage motor (hereinafter also referred to as "CR motor") 30 for driving the carriage 28; a linear encoder 11 that is fastened to the carriage 28; a rotary encoder 13, which is not shown, for the motor 31; the platen 26 for supporting the print paper P; the paper feed roller 24 driven by the PF motor 31 for conveying the print paper P; a pulley 25 attached to the rotational shaft of the CR motor 30; and the pull belt 32 driven by the pulley 25.

Figure 5:
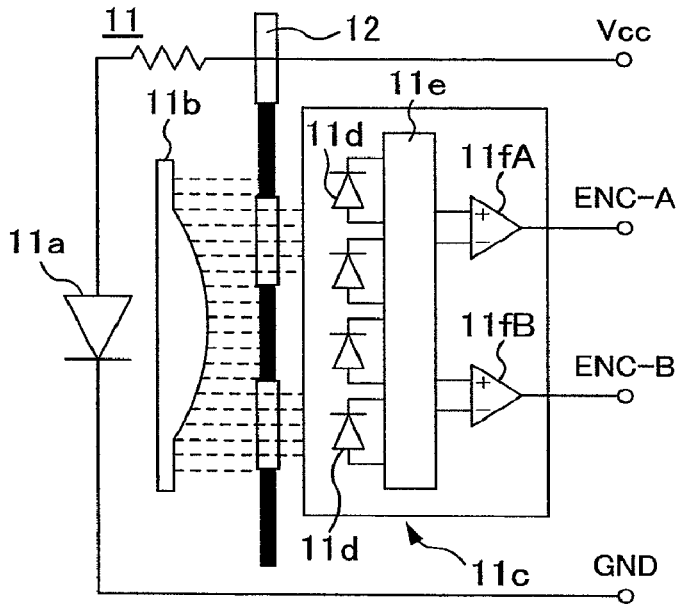
FIG. 5 is an explanatory diagram that schematically shows a configuration of a linear encoder 11 attached to the carriage 28.

Next, the above-described linear encoder 11 and the rotary encoder 13 are described. FIG. 5 is an explanatory diagram that schematically shows the configuration of a linear encoder 11 attached to the carriage 28.

The linear encoder 11 shown in FIG. 5 is provided with a light emitting diode 11*a*, a collimating lens 11*b*, and a detection processing section 11*c*. The detection processing section 11*c* has a plurality of (for example, four) photodiodes 11*d*, a signal processing circuit 11*e*, and for example two comparators 11*f*A and 11*f*B.

Light is emitted from the light-emitting diode 11*a* when a voltage Vcc is applied to it via resistors on both sides of the light-emitting diode 11*a*. This light is collimated into parallel light by the collimating lens 11*b* and passes through the linear encoder code plate 12. The linear encoder code plate 12 is provided with slits at a predetermined spacing (for example, 1/180 inch (one inch=2.54 cm)).

The parallel light that has passed through the linear encoder code plate 12 then passes through stationary slits (not shown) and enters the photodiodes 11*d*, where it is converted into an electric signal. The electric signal that is output from the four photodiodes 11*d* is subjected to signal processing in the signal processing circuit 11*e*, and the electric signal that is output by the signal processing circuit 11*e* is compared in the comparators 11*f*A and 11*f*B, and the results of these comparisons are output as pulses. A pulse ENC-A and a pulse ENC-B that are output from the comparators 11*f*A and 11*f*B become the output of the linear encoder 11.

Figure 6:
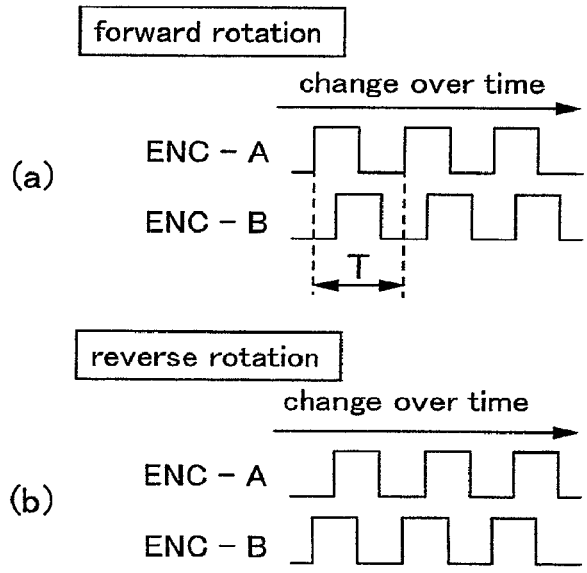
FIG. 6 shows timing charts of the waveforms of the two output signals of the linear encoder 11 when a CR motor is rotating forward, and when it is rotating in reverse.

FIG. 6 shows timing charts of the waveforms of the two output signals of the linear encoder 11 when the CR motor is rotating forward, and when it is rotating in reverse.

As shown in FIG. 6(*a*) and FIG. 6(*b*), the phases of the pulse ENC-A and the pulse ENC-B differ by 90 degrees both when the CR motor is rotating forward and when it is rotating in reverse. When the CR motor 30 is rotating forward, that is, when the carriage 28 is moving in the main scanning direction, then, as shown in FIG. 6(*a*), the phase of the pulse ENC-A leads the phase of the pulse ENC-B by 90 degrees, but when the CR motor 30 is rotating in reverse, then, as shown in FIG. 6(*b*), the phase of the pulse ENC-A trails the phase of the pulse ENC-B by 90 degrees. A single period T of the pulse ENC-A and the pulse ENC-B is equivalent to the time during which the carriage 28 is moved by the slit spacing of the linear encoder code plate 12.

Then, the rising edge and the rising edge of each of the output pulses ENC-A and ENC-B from the linear encoder 11 are detected, and the number of detected edges is counted. The rotational position of the CR motor 30 is detected based on the number that is counted. The counting is performed as follows: when the CR motor 30 is rotating forward, "+1" is added for each detected edge, and when the CR motor 30 is rotating in reverse, "−1" is added for each detected edge. The period of the pulses ENC-A and ENC-B is equal to the time from when one slit of the linear encoder code plate 12 passes through the linear encoder 11 to when the next slit passes through the linear encoder 11, and the phases of the pulse ENC-A and the pulse ENC-B are misaligned by 90 degrees. Accordingly, a count value of "1" in the calculation corresponds to ¼ of the slit spacing of the linear encoder code plate 12. Therefore, by multiplying the counted number by ¼ of the slit spacing, the amount that the CR motor 30 has moved from the rotational position corresponding to the count value "0" can be obtained based on this product. The resolution of the linear encoder 11 in this case is ¼ the slit spacing of the linear encoder code plate 12.

On the other hand, the rotary encoder 13 for the PF motor 31 has the same configuration as the linear encoder 11, except that the rotary encoder code plate 14 is a rotation disk that rotates in conjunction with rotation of the PF motor 31. The rotary encoder 13 outputs two output pulses ENC-A and ENC-B, and based on this output, the amount of movement of the PF motor 31 can be obtained.

Example of the Electrical Configuration of the Color Inkjet Printer

Figure 7:
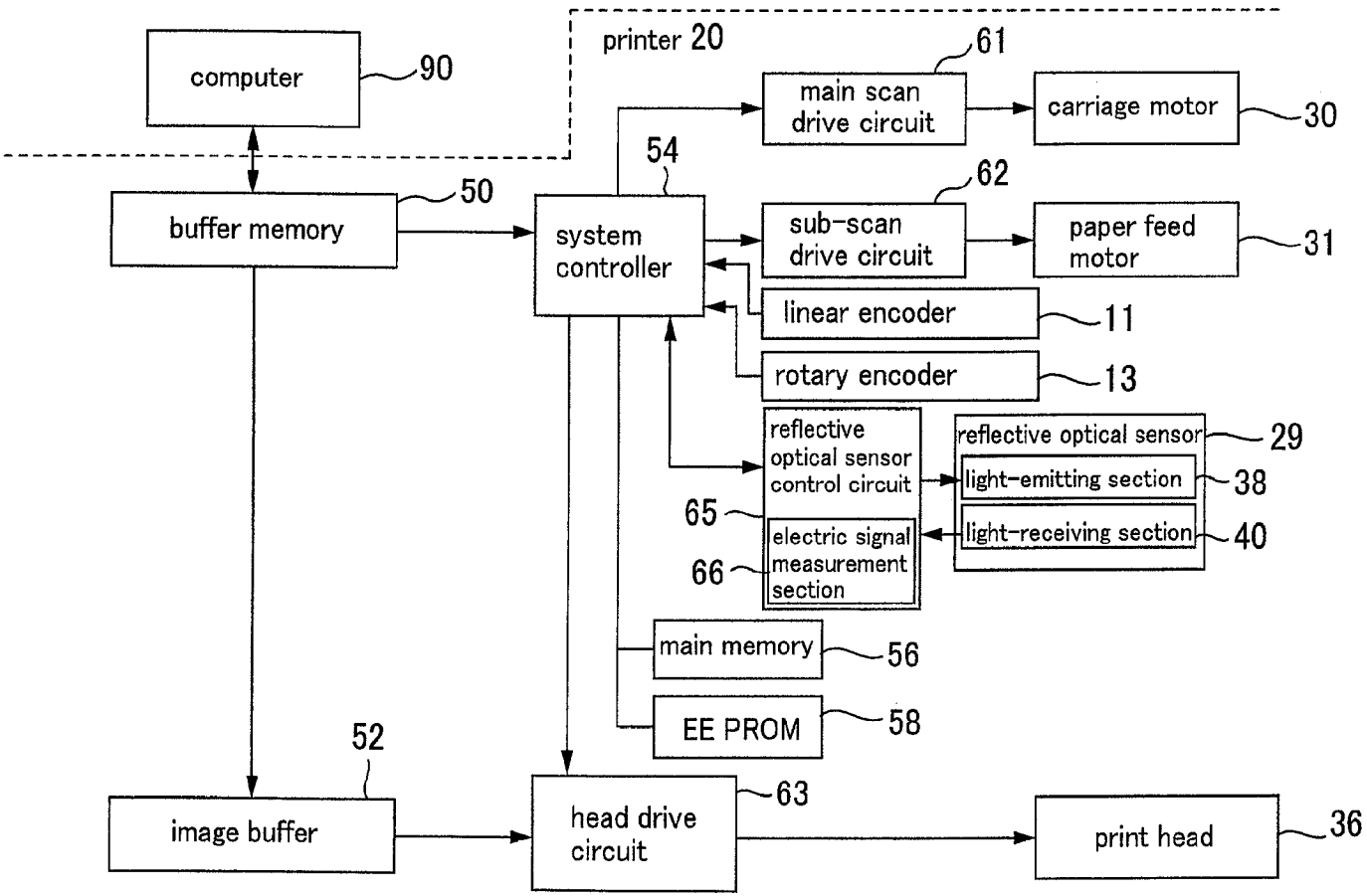
FIG. 7 is a block diagram showing one example of the electrical configuration of the color inkjet printer 20.

FIG. 7 is a block diagram showing one example of the electrical configuration of the color inkjet printer 20. The color inkjet printer 20 is provided with: a buffer memory 50 for receiving signals supplied from the computer 90; an image buffer 52 for storing print data; a system controller 54 for controlling the overall operation of the color inkjet printer 20

(also simply referred to as "controller"); a main memory 56; and an EEPROM 58. The system controller 54 is connected to: a main-scan drive circuit 61 for driving the carriage motor 30; a sub-scan drive circuit 62 for driving the paper feed motor 31; a head drive circuit 63 for driving the print head 36; a reflective optical sensor control circuit 65 for controlling the light-emitting section 38 and the light-receiving section 40 of the reflective optical sensor 29; the above-described linear encoder 11; and the above-described rotary encoder 13. The reflective optical sensor control circuit 65 is provided with an electric signal measuring section 66 for measuring the electric signals that are converted from the reflected light received by the light-receiving section 40.

The print data that is transferred from the computer 90 is temporarily held in the buffer memory 50. Within the color inkjet printer 20, the system controller 54 reads necessary information from the print data from the buffer memory 50, and based on this information sends control signals to the main-scan drive circuit 61, the sub-scan drive circuit 62, the head drive circuit 63, etc.

Print data for a plurality of color components is received by the buffer memory 52 and stored in the image buffer 50. The head drive circuit 63 reads the print data of each of the color components from the image buffer 52 in accordance with the control signals from the system controller 54, and drives the nozzle arrays provided for each of the colors in the print head 36 in correspondence with the print data.

Example Nozzle Arrangement of Print Head, Etc.

Figure 8:
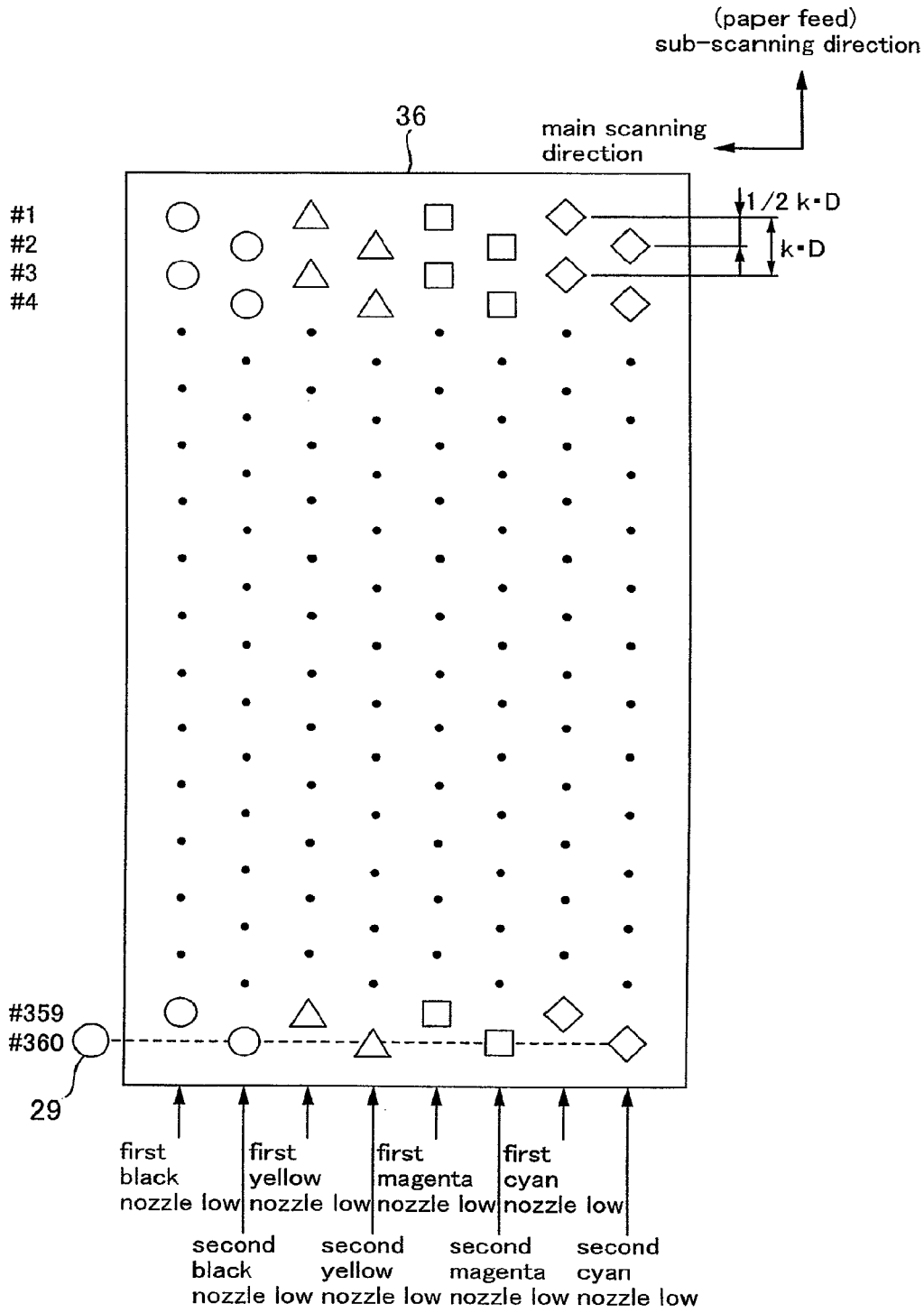
FIG. 8 is an explanatory diagram showing a nozzle arrangement on a bottom surface of a print head 36.

FIG. 8 is an explanatory diagram showing a nozzle arrangement in the bottom surface of the print head 36. The print head 36 has black nozzle rows, yellow nozzle rows, magenta nozzle rows, and cyan nozzle rows, arranged in straight lines in the sub-scanning direction. As shown in the diagram, there are two each of these nozzle rows, and in this specification, these nozzle rows are referred to as the first black nozzle row, the second black nozzle row, the first yellow nozzle row, the second yellow nozzle row, the first magenta nozzle row, the second magenta nozzle row, the first cyan nozzle row, and the second cyan nozzle row.

The black nozzle rows (shown by the white circles) include 360 nozzles, #1 to #360. Of these nozzles, the odd-numbered nozzles #1, #3, . . . , #359 belong to the first black nozzle row and the even-numbered nozzles #2, #4, . . . , #360 belong to the second black nozzle row. The nozzles #1, #3, . . . , #359 of the first black nozzle row are arranged at a constant nozzle pitch of k·D in the sub-scanning direction. Here, D is the dot pitch in the sub-scanning direction, and k is an integer. The dot pitch D in the sub-scanning direction is also equal to the pitch of the main scan lines (raster lines). Hereafter, the integer k indicating the nozzle pitch of k·D is referred to simply as the "nozzle pitch k." In the example of FIG. 8, the nozzle pitch k is four dots. The nozzle pitch k, however, may be set to any integer.

The nozzles #2, #4, . . . , #360 of the second black nozzle row are also arranged at the constant nozzle pitch k·D (nozzle pitch k=4) in the sub-scanning direction, and as shown in the diagram, the positions of the nozzles in the sub-scanning direction are offset in the sub-scanning direction with respect to the positions of the nozzles of the first black nozzle row. In the example of FIG. 8, the amount of this offset is (½)·k·D (k=4).

The above-described matters also apply for the yellow nozzle rows (shown by white triangles), the magenta nozzle rows (shown by white squares), and the cyan nozzle rows (shown by white diamonds). In other words, in each of the these nozzle rows, the 360 nozzles are arranged such that the nozzles #1, #3, . . . , #359 belong to the first nozzle row and the nozzles #2, #4, . . . , #360 belong to the second nozzle row. Also, each of these nozzle rows is arranged at a constant nozzle pitch k·D in the sub-scanning direction, and the positions of the nozzles of the second rows in the sub-scanning direction are offset with respect to the positions, in the sub-scanning direction, of the nozzles of the first rows by (½)·k·D (k=4).

In other words, the nozzle groups arranged in the print head 36 are staggered, and during printing, ink droplets are ejected from each of the nozzles while the print head 36 is moved in the main scanning direction at a constant velocity together with the carriage 28. However, depending on the print mode, there may be cases where all nozzles might not necessarily always be used and only some of the nozzles are used.

It should be noted that the above-described reflective optical sensor 29 is attached to the carriage 28 together with the print head 36, and in this embodiment, as shown in the diagram, the position of the reflective optical sensor 29 in the sub-scanning direction matches the position of the above-described nozzles #360 in the sub-scanning direction.

First Embodiment

Figure 9:
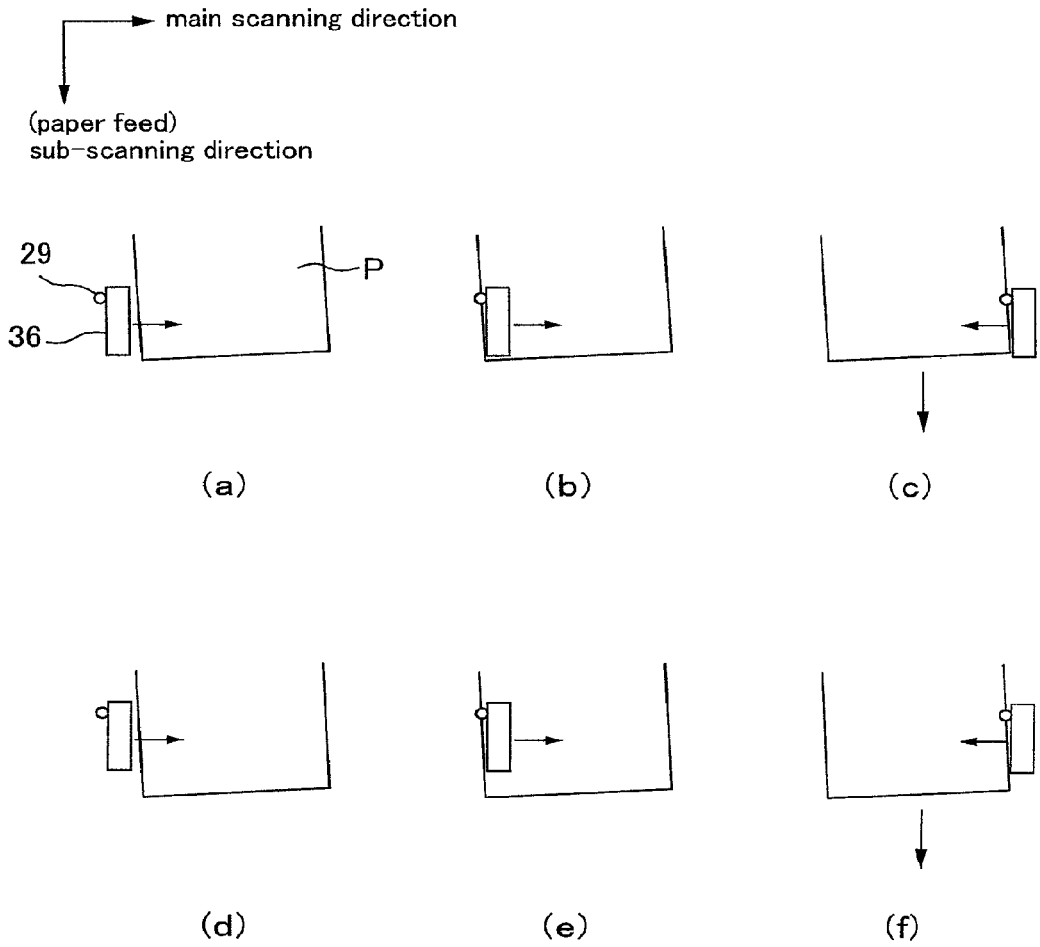
FIG. 9 is a diagram schematically showing the positional relationship of the print head 36, the reflective optical sensor 29, and a print paper P.
Figure 10:
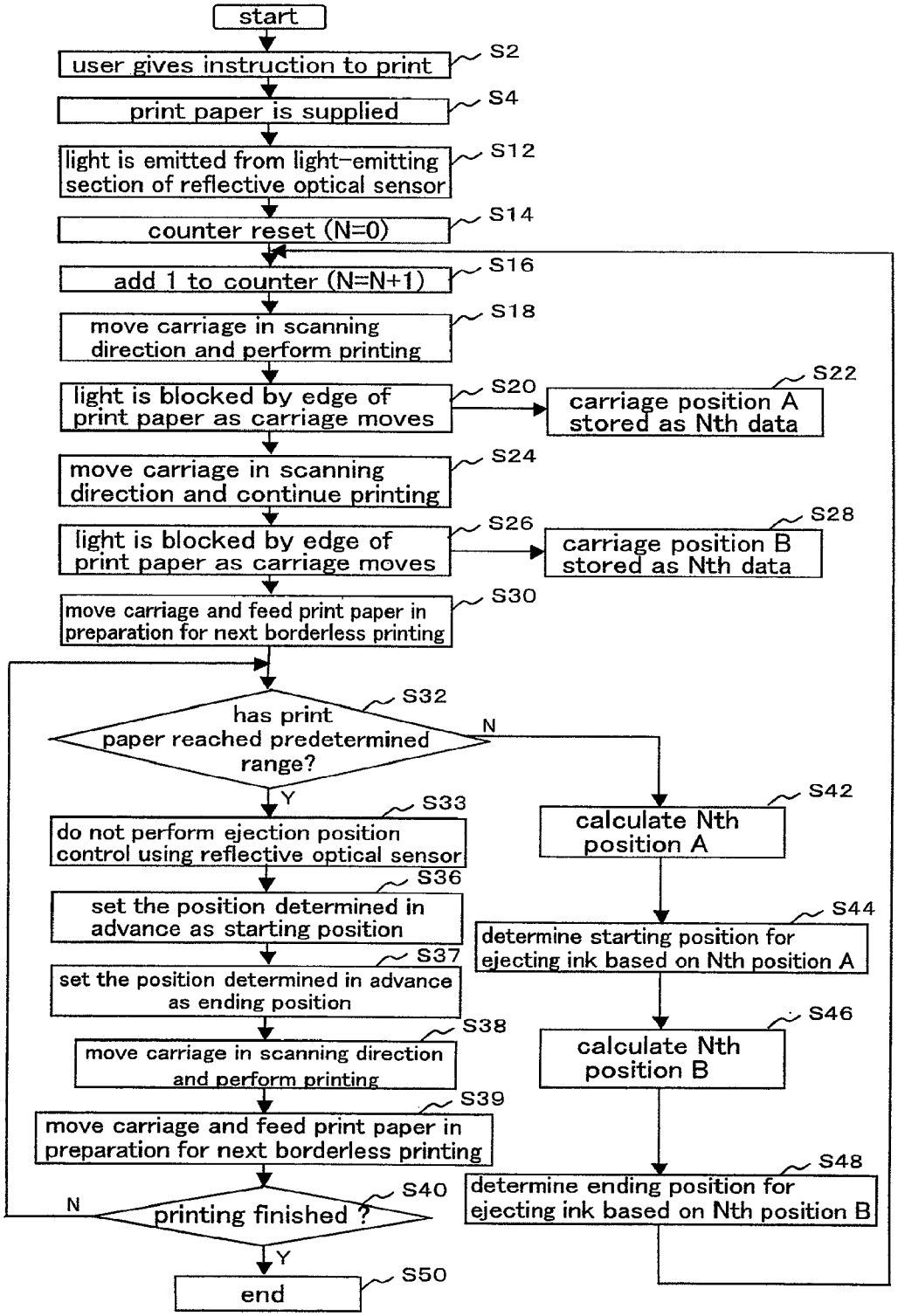
FIG. 10 is a flowchart describing a first embodiment.

Next, a first embodiment of the present invention is described using FIG. 9 and FIG. 10. FIG. 9 is a diagram that schematically shows the positional relationship of the print head 36, the reflective optical sensor 29, and the print paper P. FIG. 10 is a flowchart for describing the first embodiment.

First, the user makes an instruction to perform printing through the application program 95 or the like (Step S2).

When the application program 95 receives this instruction and issues a print command, the printer driver 96 of the computer 90 receives image data from the application program 95 and converts it to print data PD, which includes raster data indicating the state in which dots are formed during main scanning and data indicating the sub-scanning feed amount. Moreover, the printer driver 96 supplies the print data PD to the color inkjet printer 20 together with various commands COM. The color inkjet printer 20 receives these at its buffer memory 50, after which it sends them to the image buffer 52 or the system controller 54.

The user can also designate the size of the print paper P or issue a command to perform borderless printing to the user interface display module 101. This instruction by the user is received by the user interface display module 101 and sent to the UI printer interface module 102. The UI printer interface module 102 interprets the instruction that has been given, and sends a command COM to the color inkjet printer 20. The color inkjet printer 20 receives the command COM at the buffer memory 50 and then transmits it to the system controller 54.

The color inkjet printer 20 then drives, for example, the paper feed motor 31 with the sub-scan drive circuit 62 based on the command that is sent to the system controller 54 so as to supply the print paper P (Step S4).

It should be noted that the print paper P is fed in the paper feed direction by driving the paper feed motor 31 using the sub-scan drive circuit 62, the carriage 28 is moved in the scanning direction by driving the carriage motor 30 using the main-scan drive circuit 61, and ink is ejected from the print head 36 by driving the print head 36 using the head drive circuit 63.

Next, the system controller 54 controls the reflective optical sensor 29, which is provided in the carriage 28, with the reflective optical sensor control circuit 65, so that light is emitted toward the platen 26 from the light-emitting section 38 of the reflective optical sensor 29 (Step S12). A counter (not shown) is prepared in order to count the following series of repeated operations. Here, the system controller 54 resets the counter (Step S14). This reset is realized by setting a counter value N to 0, for example.

Next, the system controller 54 adds 1 to the counter value (Step S16) and moves the carriage 28 by driving the CR motor 30 using the main-scan drive circuit 61 in order to perform borderless printing by ejecting ink from the print head 36 provided to the carriage 28, as shown in FIG. 9(*a*) (Step S18). As shown in FIG. 9(*b*), a right or left edge of the print paper P eventually blocks the light emitted from the light-emitting section 38 (Step S20). The place on which light emitted from the light-emitting section 38 is incident changes at this time from the platen 26 to the print paper P, thus causing a change in the intensity of the electric signal, which is an output value of the light-receiving section 40 of the reflective optical sensor 29 that has received the reflected light. The intensity of the electric signal is then measured by the electric signal measuring section 66, and it is detected that the light has passed an edge of the print paper P.

An amount of movement from a reference position of the CR motor 30 is then determined from the output pulse from the linear encoder 11, and this amount of movement, which is in other words the position of the carriage 28 (hereinafter also referred to as "position A"), is stored as the Nth data (Step S22).

As shown in FIG. 9(*b*) and FIG. 9(*c*), also after Step S16 and Step S18 described above, the system controller 54 moves the carriage 28 and performs borderless printing by ejecting ink from the print head 36 provided to the carriage 28 (Step S24).

As shown in FIG. 9(*c*), a left or right edge (an edge whose position in the main scanning direction is different from the blocking edge in Step S20) of the print paper P eventually blocks the light emitted from the light-emitting section 38 (Step S26). The place on which light from the light-emitting section 38 is incident changes at this time from the print paper P to the platen 26, thus causing a change in the intensity of the electric signal, which is an output value of the light-receiving section 40 of the reflective optical sensor 29 that has received the reflected light. The intensity of the electric signal is then measured by the electric signal measuring section 66, and it is detected that the light has passed an edge of the print paper P.

An amount of movement from a reference position of the CR motor 30 is then determined from the output pulse of the linear encoder 11, and the amount of movement, which is in other words the position of the carriage 28 (hereinafter also referred to as "position B"), is stored as the Nth data (Step S28).

Next, as shown in FIG. 9(*c*) and FIG. 9(*d*), the system controller 54 drives the CR motor 30 and moves the carriage 28, and also drives the paper feed motor 31 to feed the print paper P by a predetermined amount, to prepare for the next borderless printing (Step S30).

Next, the system controller 54 counts the paper feed amount in the sub-scanning direction of the print paper P, and judges whether or not the print paper P has reached the predetermined range set in advance (Step S32).

Figure 12:
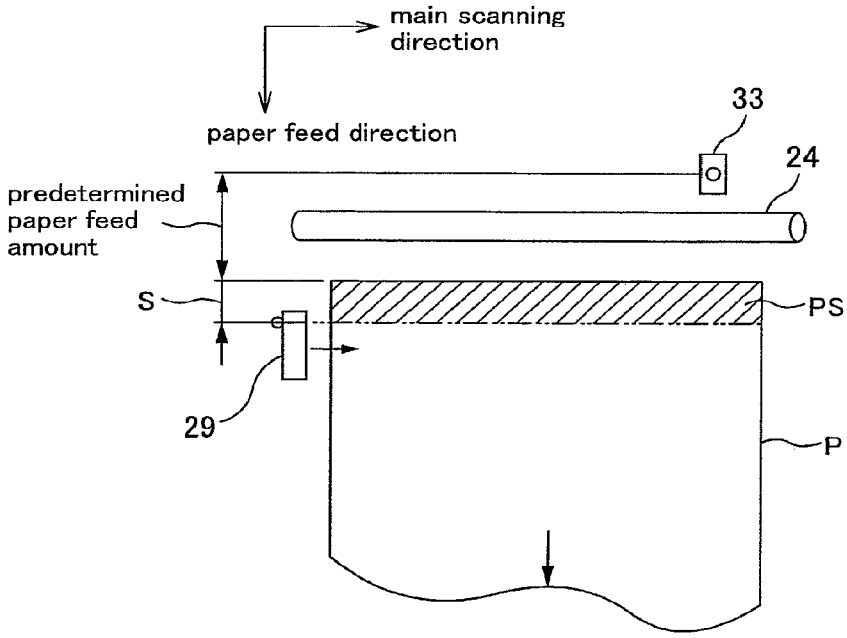
FIG. 12 is a schematic diagram illustrating a position of the print paper P in order to determine whether or not to control determination of the left and right edge positions of the print paper P using the reflective optical sensor 29.

Here, the "predetermined range set in advance" is described with reference to FIG. 12. FIG. 12 is a schematic diagram illustrating a position of the print paper P for determining whether or not to control determination of the left and right edge positions of the print paper P using the reflective optical sensor 29. The "predetermined range set in advance" means a state in which the reflective optical sensor 29 is in opposition to the vicinity of the lower edge (also referred to as "rear edge") of the print paper P.

Whether or not the print paper P has reached the predetermined range is judged based on a "predetermined paper feed amount" of the print paper P after the bottom edge of the print paper P has been detected by the paper end detection device 33. In other words, the print paper P is judged to have reached the predetermined range when the gap between the bottom edge of the print paper P and the light-receiving section 40 on the reflective optical sensor 29 becomes equal to or smaller than S (in the present example, this is set to between 5 and 7 millimeters from the bottom edge) (see FIG. 12).

Another example of judging whether the predetermined range has been reached or not is a method in which the paper feed amount is counted using the ink ejection starting position at the top edge (also referred to as "front edge") of the print paper P as a reference, and this count value is used in judging.

As another example, it is also possible to judge whether or not the predetermined range has been reached by using a control signal controlling the ink ejection apparatus as a trigger. Here, an example of such a control signal is given. In order to deal with a situation in which the print paper P is overfed (a situation in which the paper is said to be "kicked"), which occurs when printing and feeding of the print paper P progresses and the bottom edge of the print paper P comes off from the paper feed roller 24, the paper feed roller 24 slows its speed as the bottom edge of the print paper P reaches the paper feed roller 24, and once the print paper P completely exits the paper feed roller 24, it regains a fast paper feed speed (this is referred to as "breaking control"). It is also possible to use the signal for changing the paper feed speed as a trigger in judging whether or not the predetermined range has been reached or not; specifically, the timing signal which returns the paper feed speed back to the fast speed can be used.

It is also possible to judge whether or not the print paper P has reached the predetermined range using as a trigger a signal which accompanies changes in the paper feed amount when performing borderless printing in the vicinities of the top and bottom edges of the print paper.

Figure 11:
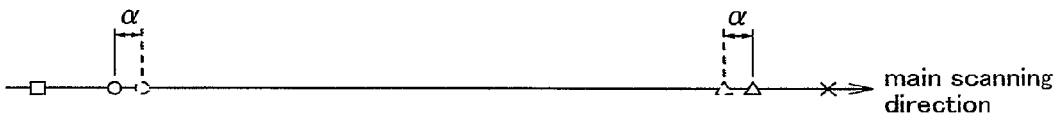
FIG. 11 is an explanatory diagram describing a method for determining an ink ejection starting position and an ink ejection ending position.

The description now returns to the flowchart in FIG. 10. Referring also to FIG. 11, the following is a description of the process that takes place when it is judged that the bottom edge of the print paper P has reached the predetermined range PS by judging whether or not the print paper P has reached the predetermined range set in advance (Step S32). FIG. 11 is an explanatory diagram describing a method for determining an ink ejection starting position and an ink ejection ending position.

After the bottom edge of the print paper P is judged as having reached the predetermined range PS, detection of the left and right edges of the print paper P using the reflective optical sensor 29 is not performed (Step S33), and "positions determined in advance" are set as the starting position for ejecting ink (indicated by a square in FIG. 11) (Step S36) and the ending position for ejecting ink (indicated by a small cross in FIG. 11) (Step S37), regardless of the Nth positions.

Here, the "starting position and ending position determined in advance" should be set while taking into consideration the aspect of not creating unneeded margins in the print paper P and should be set with sufficient leeway with regard to the size (width) of the print paper.

In the process described above, no detection of the left and right edges of the print paper P using the reflective optical sensor 29 is performed after it is judged that the bottom edge of the print paper P has reached the predetermined range PS. However, it is also possible to obtain data by performing left and right edge detection of the print paper P using the reflective optical sensor 29, but not determine the ink ejection starting position and the ink ejection ending position using this data.

The system controller 54 further moves the carriage 28, performs printing using the above-described ink ejection starting position and ending position (Step S38), moves the carriage 28 and feeds the print paper P by a predetermined amount, and prepares for the next borderless printing (Step S39). If printing is confirmed as finished (Step S40: Y), the printing process is terminated (Step S50), and if printing is not confirmed as finished (Step S40: N), the process starting at Step S32 is executed.

On the other hand, if the print paper P has not reached the predetermined range (Step S32: N), the process returns to Step S16 after the ink ejection starting position and the ink ejection ending position have been determined (Steps S42-S48), and the system controller 54 adds 1 to the counter value N (Step S16), and thereafter, as shown in FIG. 9(*d*), FIG. 9(*e*), and FIG. 9(*f*), the procedure starting with Step S18 described above is executed.

Now Steps S42-S48 are described in more detail. First, the system controller 54 reads data from the storage region corresponding to the Nth position A stored in Step S20 and Step S22, and obtains the position of the Nth position A (indicated by a dotted circle in FIG. 11), which is one of the left and right edges of the print paper P (Step S42).

Based on this Nth position A (indicated by a dotted circle in FIG. 11) obtained from the stored data, the starting position for ejecting ink is determined (Step S44). For example, as shown in FIG. 11, a position which takes into account a leeway of a distance $\alpha$ from the Nth position A is determined as the ink ejection starting position (indicated by a solid circle in FIG. 11).

Next, the system controller 54 reads data from the storage region corresponding to the Nth position B stored in Step S26 and Step S28, and obtains the Nth position B (indicated by a dotted triangle in FIG. 11), which is one of the left and right edges of the print paper P (Step S46). As in Step S44, based on this Nth position B (indicated by a dotted triangle in FIG. 11) obtained from the stored data, the ending position for ejecting ink is determined (Step S48). For example, as shown in FIG. 11, a position which takes into account a leeway of a distance a from the Nth position B is determined as the ink ejection ending position (indicated by a solid triangle in FIG. 11).

In the above, in order to determine the Nth position A or the Nth position B, the position A and position B detected previously are used; so if this past position information is insufficient, then the positions determined in advance may be used as the starting position (indicated by a square in FIG. 11) and the ending position (indicated by a small cross in FIG. 11) for ejecting ink, just as described in the former embodiment.

Note that the leeway a takes into consideration the aspect of not creating an unneeded margin on the print paper P and is, for example, set based on a detection error, etc., when detecting the left and right edges of the print paper P. Furthermore, in the above, the value of the leeway a was the same value when determining the starting position and when determining the ending position, but it is also possible to set different values.

Further, a program for carrying out the above processes is stored in the EEPROM 58, and that program is executed by the system controller 54.

As described in the section on the Background Art, in order to mitigate the problem of wasteful ink consumption due to printing being performed in regions outside the print paper, it is effective to detect the positions of the left and right edges of the print paper and change the starting position and ending position for ejecting ink in accordance with the positions of the left and right edges that have been detected; however, when using this measure, in the vicinities of the top and bottom edges of the print paper, it is possible that a shift may occur in the detected positions of the left and right edges of the print paper due to a detection error in the detection means. This type of detected position shift is a problem which occurs when detecting the positions of the left and right edges by moving the illumination spot on the print paper of the left-and-right-edge detection sensor in the main scanning direction and detecting changes in the amount of reflected light received over the left and right edges of the print paper. When the top and bottom edges of the print paper are contained in the diameter of the illumination spot, detection results are obtained which seem to indicate that the left and right edges are further inward than the actual left and right edge positions, due to there being less reflected light there than in other portions of the left and right edges of the print paper. Since the starting position and the ending position for ejecting ink are determined based on these erroneous detection results, the starting position or the ending position for ejecting ink is set to a position further inward from the actual left and right edges of the print paper. In other words, margin portions will be created in portions where ink is not ejected.

In such situations, there is the possibility that a margin might mistakenly be created in the print paper if the starting position and the ending position for ejecting ink in the next main scan are determined simply by using information about the positions of the left and right edges detected during the immediately preceding main scan, without changing the procedure for determining the starting position and the ending position. This problem is likely to occur especially in cases where the print paper is supplied at an angle (skewed).

In order to deal with this, as described above, when the position of the print paper in the paper feed direction reaches a predetermined position set in advance (i.e., a position set immediately before the reflective optical sensor for detecting the left and right edges of the print paper reaches the top or bottom edge of the print paper), detection of the left and right edges of the print paper using the reflective optical sensor is not performed, or, even if data is obtained by detecting the left and right edges of the print paper using the reflective optical sensor the starting and ending positions for ejecting ink are not determined using this data. Rather, the ink ejection starting position and the ink ejection ending position are set to positions determined in advance. In this way, it is possible to avoid mistakenly creating a margin on the print paper.

Second Embodiment

Figure 13:
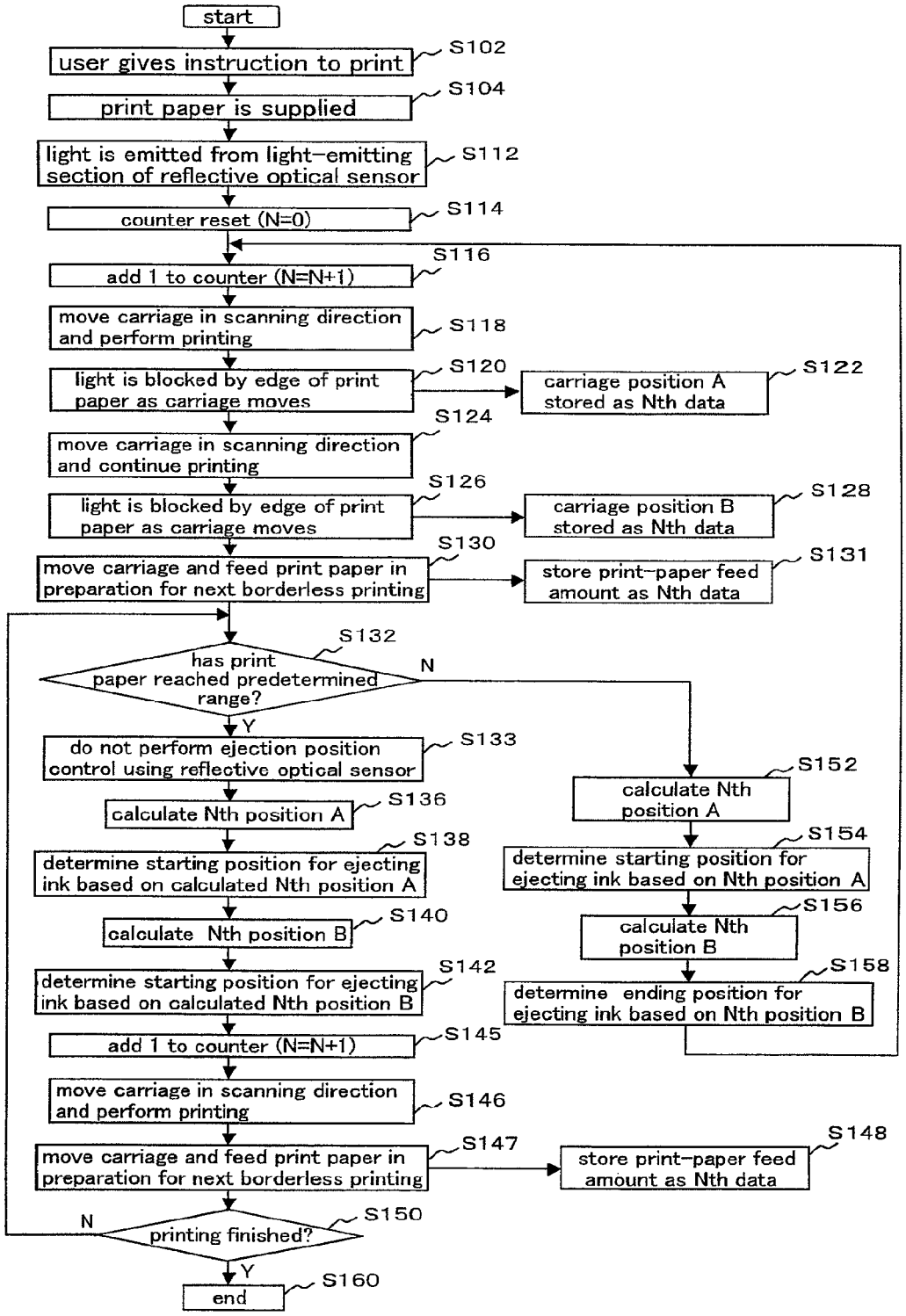
FIG. 13 is a flowchart describing a second embodiment.

Next, a second embodiment of the present invention is described referring to FIG. 9 and FIG. 13. FIG. 13 is a flowchart for describing the second embodiment.

The flowchart begins with a user giving an instruction to perform printing in the application program 95 etc. (Step S102), but from then on until Step S130, the procedure is the same as Step S2 through Step S30 described with respect to the first embodiment.

In Step S130, as shown in FIG. 9(*c*) and FIG. 9(*d*), the system controller 54 drives the CR motor 30 and moves the carriage 28, and also drives the paper feed motor 31 to feed the print paper P by a predetermined amount, to prepare for the next borderless printing. At this time, the system controller 54 determines the amount of movement from a reference position for the PF motor 31 based on output pulses from the rotary encoder 13, and stores this amount of movement, or in other words, the feed amount of the print paper P (Step S131).

Next, the system controller 54 judges whether or not the print paper P has reached the predetermined range set in advance, based on the feed amount in the sub-scanning direction of the print paper P (Step S132). The "predetermined range set in advance" means a state in which the reflective optical sensor 29 is in opposition to the vicinity of the lower edge (also referred to as "rear edge") of the print paper P, but this is the same as in the "predetermined range" described in the first embodiment, so no further description is given here.

If the print paper P is judged as not having reached the predetermined range (Step S132: N), the system controller 54 obtains the Nth position A which is either the left or the right edge of the print paper P (Step S152), determines the ink ejection starting position based on the Nth position A (Step S154), obtains the Nth position B (Step S156), and determines the ink ejection ending position based on the Nth position B (Step S158), but these processes are the same as the processes described in the first embodiment. Thereafter, the procedure returns to Step S116, and the system controller 54 adds 1 to the counter value N (Step S116), and the procedure starting with Step S118 is executed.

Next, referring to FIG. 11 and FIG. 12, the following is a description of the process when it is judged that the print paper has reached the predetermined range (Step S132: Y).

After the print paper is judged as having reached the predetermined range (Step S132: Y), no detection of the left and right edges of the print paper P using the reflective optical sensor 29 is performed (Step S133), and the ink ejection starting position and the ink ejection ending position are determined using a method described below (Step S136 to Step S142). Note that it is also possible to obtain data by performing detection of the left and right edges of the print paper P using the reflective optical sensor 29, but not determine the ink ejection starting position and the ink ejection ending position using this data.

Next, the system controller 54 adds 1 to the counter value (Step S145), and performs printing by driving the CR motor 30 with the main-scan drive circuit 61 and moving the carriage 28 (Step S146). At this time, the system controller 54 controls the head drive circuit 63 and begins the ejection of ink starting at the ink ejection starting position that has been determined, and finishes the ejection of ink at the ink ejection ending position that has been determined.

Next, the system controller 54 drives the CR motor 30 to move the carriage 28, and also drives the paper feed motor 31 to feed the print paper P by a predetermined amount, and prepares for the next borderless printing (Step S147). At this time, the system controller 54 obtains the amount of movement from a reference position of the PF motor 31 based on the output pulses of the rotary encoder 13, and this amount of movement, which in other words is the feed amount of the print paper P, is stored (Step S148).

Next, in Step S150, the system controller 54 judges whether or not the printing end position has been reached, and if printing has not finished, returns to Step S132 and judges whether or not the print paper has reached the predetermined range. Thereafter the procedure starting at Step S132 described above is executed. If the judgment in Step S150 is that printing is finished, then printing is terminated (Step S160).

Next, four examples are described of how to calculate the ink ejection starting position and the ink ejection ending position (Step S136 to Step S142) when the judgment in Step S132 is that the bottom edge of the print paper P has reached the predetermined range PS.

Calculation Method 1

The ink ejection starting position and the ink ejection ending position are calculated using the positions of the left and right edges detected immediately before the bottom edge of the print paper P reaches the predetermined range PS (these have already been stored as N'th position data), and these calculated positions are always used after the bottom edge of the print paper P reaches the predetermined range PS.

Specifically, the system controller 54 reads data from the storage region corresponding to the N'th position A stored in Step S120 and Step S122, and calculates the position of the N'th position A (indicated by a dotted circle in FIG. 11), which is the position of one of the left and right edges of the print paper P that has been stored (Step S136). The ink ejection starting position is determined based on the calculated N'th position A (Step S138). For example, as shown in FIG. 11, a position which takes into account a leeway of a distance $\alpha$ from the N'th position A (indicated by a solid circle in FIG. 11) is determined as the ink ejection starting position, and is fixed (always used) as the ink ejection starting position when the bottom edge of the print paper P is judged as having reached the predetermined range PS.

Similarly, the system controller 54 reads data from the storage region corresponding to the N'th position B stored in Step S126 and Step S128, and calculates the position of the N'th position B (indicated by a dotted triangle in FIG. 11), which is the position of one of the left and right edges of the print paper P that has been stored (Step S140). The ink ejection ending position is determined based on the calculated N'th position B (Step S142).

For example, as shown in FIG. 11, a position which takes into account a leeway of a distance a from the N'th position B (indicated by a solid triangle in FIG. 11) is determined as the ink ejection ending position, and is fixed (always used) as the ink ejection ending position when the bottom edge of the print paper P is judged as having reached the predetermined range PS.

Calculation Method 2

It is also possible to calculate the positions of the left and right edges from two sets of left and right edge positions detected in the past and the amount the print paper P has been fed from the time those edge positions were detected, and then determine the ink ejection starting position and the ink ejection ending position based on those calculated left and right edge positions.

For example, assuming the (M−1)th position A, the Mth position A, and the Nth position A, which is being calculated here, are Xam−1, Xam, and Xan, respectively (here, M being the (N−x)th position detected in the past, so M<N), and further assuming that the (M−2)th feed amount, the (M−1)th feed amount, and the (N−1)th feed amount for the print paper P stored in Step S131 or Step S148 are Pm−2, Pm−1, and Pn−1, respectively, then, Xan, which is the Nth position A to be calculated here, can be calculated from the relationship (Xan−Xam)/(Xan−Xam-1)=(Pn−1−Pm−1)/(Pn−1−Pm−2) (Step S136).

In other words, Xan=((Pn−1−Pm−2)·Xam−(Pn−1−Pm−1)·Xam−1/(Pm−1−Pm−2), meaning it is possible to calculate Xan from Xam−1, Xam, Pm−2, Pm−1, and Pn−1, which are already known.

Based on this calculated Nth position A (indicated by a dotted circle in FIG. 11), the ink ejection starting position is determined (Step S138). For example, as shown in FIG. 11, a position which takes into account a leeway of a distance $\alpha$ from the Nth position A is determined as the ink ejection starting position (indicated by a solid circle in FIG. 11).

Next, assuming the (M−1)th position B, the Mth position B, and the Nth position B, which is being calculated here, are Xbm−1, Xbm, and Xbn, respectively (here, M being the (N-x)th position detected in the past, so M<N), and further assuming that the (M−2)th feed amount, the (M−1)th feed amount, and the (N−1)th feed amount for the print paper P stored in Step S131 or Step S148 are Pm−2, Pm−1, and Pn−1, respectively, then, Xbn, which is the Nth position B, which is being calculated here, can be calculated from the relationship (Xbn−Xbm)/(Xbn−Xbm−1)=(Pn−1−Pm−1)/(Pn−1−Pm−2) (Step S140).

In other words, Xbn=((Pn−1−Pm−2)·Xbm−(Pn−1−Pm−1)·Xbm−1)/(Pm−1−Pm−2), meaning it is possible to calculate Xbn from Xbm−1, Xbm, Pm−2, Pm−1, and Pn−1, which are already known.

Based on this calculated Nth position B (indicated by a dotted triangle in FIG. 11), the ink ejection ending position is determined (Step S142). For example, as shown in FIG. 11, a position which takes into account a leeway of a distance a from the Nth position B is determined as the ink ejection ending position (indicated by a solid triangle in FIG. 11).

Note also that in the above description, the starting position and the ending position were determined based on the positions of the edges which were calculated by calculating the positions of the targeted left and right edges from the two sets of left and right edge positions that were detected in the past, but there is no limitation to this. For example, it is possible also to calculate the positions of the targeted left and right edges from three or more sets of left and right edge positions that were detected in the past. However, the above embodiment is preferable in that it makes it possible to determine the starting position or the ending position based on a minimum of information related to the positions of the left and right edges detected in the past.

Calculation Method 3

Referring to FIG. 11 and FIG. 13, the following is another example of how to calculate the ink ejection starting position and the ink ejection ending position when the judgment in Step S132 judges that the bottom edge of the print paper P has reached the predetermined range PS.

In this example, the positions of the targeted left and right edges are calculated from one position for the left and right edges detected in the past, the amount the print paper P has been fed from the time that edge position was detected, and the maximum predicted skew angle of the print paper, and then the ink ejection starting position and the ink ejection ending position are determined based on those calculated left and right edge positions.

An example is used to describe the method for calculating the ink ejection starting position. For example, assuming the Mth position A and the Nth position A, which is to be calculated, are Xam and Xan, respectively (here, M being the (N−x)th position detected in the past, so M<N), and further assuming that the (M−1)th feed amount and the (N−1)th feed amount for the print paper stored in Step S131 or Step S148 are Pm−1 and Pn−1, and further assuming that the maximum predicted skew angle is θ, then Xan, which is the Nth position A, can be calculated from the relationship (Xan−Xam)/(Pn−1−Pm−1)=tan θ (Step S136). In other words, Xan=Xam+(Pn−1−Pm−1)·tan θ, meaning it is possible to calculate Xan from Xam, Pm−1, Pn−1, and θ, which are already known.

Based on this calculated Nth position A (indicated by a dotted circle in FIG. 11), the ink ejection starting position is determined (Step S138). For example, as shown in FIG. 11, a position which takes into account a leeway of a distance a from the Nth position A is determined as the ink ejection starting position (indicated by a solid circle in FIG. 11).

An example is used to describe the method for calculating the ink ejection ending position. For example, assuming the Mth position B and the Nth position B, which is to be calculated, are Xbm and Xbn, respectively (here, M being the (N-x)th position detected in the past, so M<N), and further assuming that the (M−1)th feed amount and the (N−1)th feed amount for the print paper stored in Step S131 or Step S148 are Pm−1 and Pn−1, and further assuming that the maximum predicted skew angle is θ, then Xbn, which is the Nth position B, can be calculated from the relationship (Xbn−Xbm)/(Pn−1−Pm−1)=tan θ (Step S140). In other words, Xbn=Xbm+(Pn−1−Pm−1)·tan θ, meaning it is possible to calculate Xbn from Xbm, Pm−1, Pn−1, and θ, which are already known.

Based on this calculated Nth position B (indicated by a dotted triangle in FIG. 11), the ink ejection ending position is determined (Step S142). For example, as shown in FIG. 11, a position which takes into account a leeway of a distance α from the Nth position B is determined as the ink ejection ending position (indicated by a solid triangle in FIG. 11).

Calculation Method 4

Referring to FIG. 11 and FIG. 13, the following is another example of how to calculate the ink ejection starting position and the ink ejection ending position when the judgment in Step S132 judges that the bottom edge of the print paper P has reached the predetermined range PS.

In this example, the position of one of the left and right edges is calculated from the width of the print paper and the position of the other edge (already stored as the N'th data) of the left and right edges which was already detected immediately before the bottom edge of the print paper P reached the predetermined range, and the ink ejection starting position is determined based on this calculated edge position. This example is effective in cases where the carriage did not reach the other edge, despite having begun moving from one edge. In other words, it is effective when only the position of one of the left and right edges is stored immediately before the bottom edge of the print page P reaches the predetermined range.

The system controller 54 reads data from the storage region corresponding to the N'th position A stored in Step S120 and Step S122, and calculates the position of the N'th position A (indicated by a dotted circle in FIG. 11), which is the position of one of the left and right edges of the print paper P that has been stored (Step S136). The ink ejection starting position is determined based on the calculated N'th position A (Step S138). For example, as shown in FIG. 11, a position which takes into account a leeway of a distance α from the N'th position A is determined as the ink ejection starting position (indicated by a solid circle in FIG. 11), and is fixed as the ink ejection starting position when the bottom edge of the print paper P is judged as having reached the predetermined range PS.

Next, the position of the other one of the left or right edges is calculated from the width of the print paper and the detected Nth position A (Step S140). For example, the Nth position B is calculated by adding the width of the print paper to the detected Nth position A.

Based on this calculated Nth position B (indicated by a dotted triangle in FIG. 11), the ink ejection ending position is determined (Step S142). For example, as shown in FIG. 11, a position which takes into account a leeway of a distance α from the Nth position B is determined as the ink ejection ending position (indicated by a solid triangle in FIG. 11), and is fixed as the ink ejection ending position when the bottom edge of the print paper P is judged as having reached the predetermined range PS.

Note that in the above, the leeway a takes into consideration the aspect of not creating unneeded margin in the print paper P, and is preferably set to a sufficient leeway, for example, set based on a detection error, etc., when detecting the left and right edges of the print paper P. Furthermore, in the above, the value of the leeway a was the same value when determining the starting position and when determining the ending position, but it is also possible to set different values.

It should be noted that a program for carrying out the above processes is stored in the EEPROM 58, and that program is executed by the system controller 54.

According to the present embodiment, in cases where the position of the print paper in the paper feed direction (i.e., the bottom of the print paper) is judged as having reached the predetermined range set in advance, detection of the left and right edges of the print paper using the reflective optical sensor is not performed, but instead the ink ejection starting position and the ink ejection ending position are determined based on the positions of the left and right edges that have already been detected in the past using the above-described method. Therefore, it is possible to avoid mistakenly creating a margin on the print paper.

Furthermore, even in cases where data is obtained by detecting the left and right edges of the print paper using the reflective optical sensor, it is still possible to avoid mistakenly creating a margin on the print paper by determining the ink ejection starting position and the ink ejection ending position based on the positions of the left and right edges that have already been detected in the past using the above-described method, and not determining the ink ejection starting position and the ink ejection ending position using the above-mentioned data.

Other Embodiments

A liquid ejection apparatus, for example, according to the present invention was described above through an embodiment thereof. However, the foregoing embodiment is for the purpose of elucidating the present invention and is not to be interpreted as limiting the present invention. The invention can of course be altered and improved without departing from the gist thereof and includes equivalents.

Print paper was described as an example of the medium, but it also possible to use film, cloth, and thin metal sheets, for example, as the medium.

In the foregoing embodiments, a printing apparatus was described as an example of the liquid ejection apparatus. However, there is no limitation to this. For example, technology like that of the embodiments can also be adopted for color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. The above-described effects can be maintained even when the present technology is adopted in these fields because of the feature that liquid can be ejected toward a medium.

In the above embodiments, a color inkjet printer was described as an example of the printing apparatus; however, there is no limitation to this. For example, the present invention can also be applied to monochrome inkjet printers.

Also, in the above embodiments, ink was used as an example of the liquid; however, there is no limitation to this. For example, it is also possible to eject from the nozzles a liquid (including water) including metallic material, organic material (particularly macromolecular material), magnetic material, conductive material, wiring material, film-formation material, processed liquid, and genetic solution.

Also, in the above embodiments, the bottom edge vicinity of a print paper was described as an example. However, there is no limitation to this, and it goes without saying that this may be applied to the top edge vicinity of the print paper.

Furthermore, the edges of the print paper were detected as the print paper was carried in the paper feed direction, but a method is also possible in which the print paper is fed in advance to a detection position, the position of the edges of the print paper is detected, and then the print paper is fed back (returned) along the paper feed direction to the ejection starting position. However, the embodiment described above is preferable from the standpoint that, in this way, printing time can be reduced further.

In the above embodiments, the entire surface of the print paper is printed, or in other words, so-called borderless printing is performed, but there is no limitation to this. The above means is effective in cases where printing is performed over a wide area, even if not over the entire surface of the print paper P, for example. However, the advantages of the above means are even more pronounced for borderless printing, since printing can be performed even on edge portions of the print paper.

In the above embodiments, the reflection optical sensor is provided with a light-emitting section for emitting light and a light-receiving section for receiving the light that moves in the main scanning direction as the light-emitting means moves in the main scanning direction, and detects the position of the edge based on changes in the output value of the light-receiving section caused by the light that is emitted from the light-emitting section and that moves in the main scanning direction being blocked by the edge, but there is no limitation to this. However, the above-described embodiment is preferable in view of the fact that, in this way, the position of the edge can be detected more easily.

Furthermore, in the above embodiment, the positions of two edges with different positions in the main scanning direction are detected based on changes in the output value of the light-receiving section as light that is emitted from a light-emitting section and that moves in the main scanning direction is blocked by the edge, and the starting position is changed in accordance with the position of one of the two detected edges, while the ending position is changed in accordance with the position of the other of the two detected edges, but there is no limitation to this. For example, it is also possible to detect the position of one edge in the detection operation based on changes in the output value of the light-receiving section as the light that is emitted by the light-emitting section and that moves in the main scanning direction is blocked by the edge, and to change either the starting position or the ending position in accordance with the position of the one detected edge. However, the above-described embodiment is preferable in view of the effect described above, or in other words, in view of the fact that, in this way, the effect of it being possible to avoid mistakenly creating a margin on the print paper, is much more notable.

Moreover, in the above embodiment, a reflective optical sensor is provided to a movable carriage which is provided with a print head, but there is no limitation to this. For example, it is also possible to adopt a configuration in which the carriage and the reflective optical sensor move separately. However, the above-described embodiment is preferable in view of the fact that, in this way, the moving mechanisms of the carriage and the reflective optical sensor can be made a common mechanism.

In the above embodiment, ink is ejected from the print head onto the print paper as the position of the edge is being detected based on changes in the output value of the light-receiving sensor due to the edge of the print paper blocking the light that is emitted by the light-emitting section and that moves in the main scanning direction, while the carriage is being moved in the main scanning direction, but there is no limitation to this. For example, it is possible for the detection operation and the ejection operation to be performed separately. However, the embodiment described above is preferable in view of the fact that, in this way, efficient operation can be realized.

In the above embodiment, a case was described in which the position of the edge of the print paper was not detected due to problems with the reflective optical sensor, regardless of the fact that the light emitted from the reflective optical sensor passed the edge. The invention can also be applied to cases in which the position of the edge of the print paper is not detected due to the light emitted from the reflective optical sensor not passing the edge of the print paper, which can occur when a so-called logical seek system is adopted.

Configuration of Computer System Etc.

Next, a computer system serving as an example of an embodiment of the present invention is described with reference to the drawings. This computer system is one example of a liquid ejection system.

Figure 14:
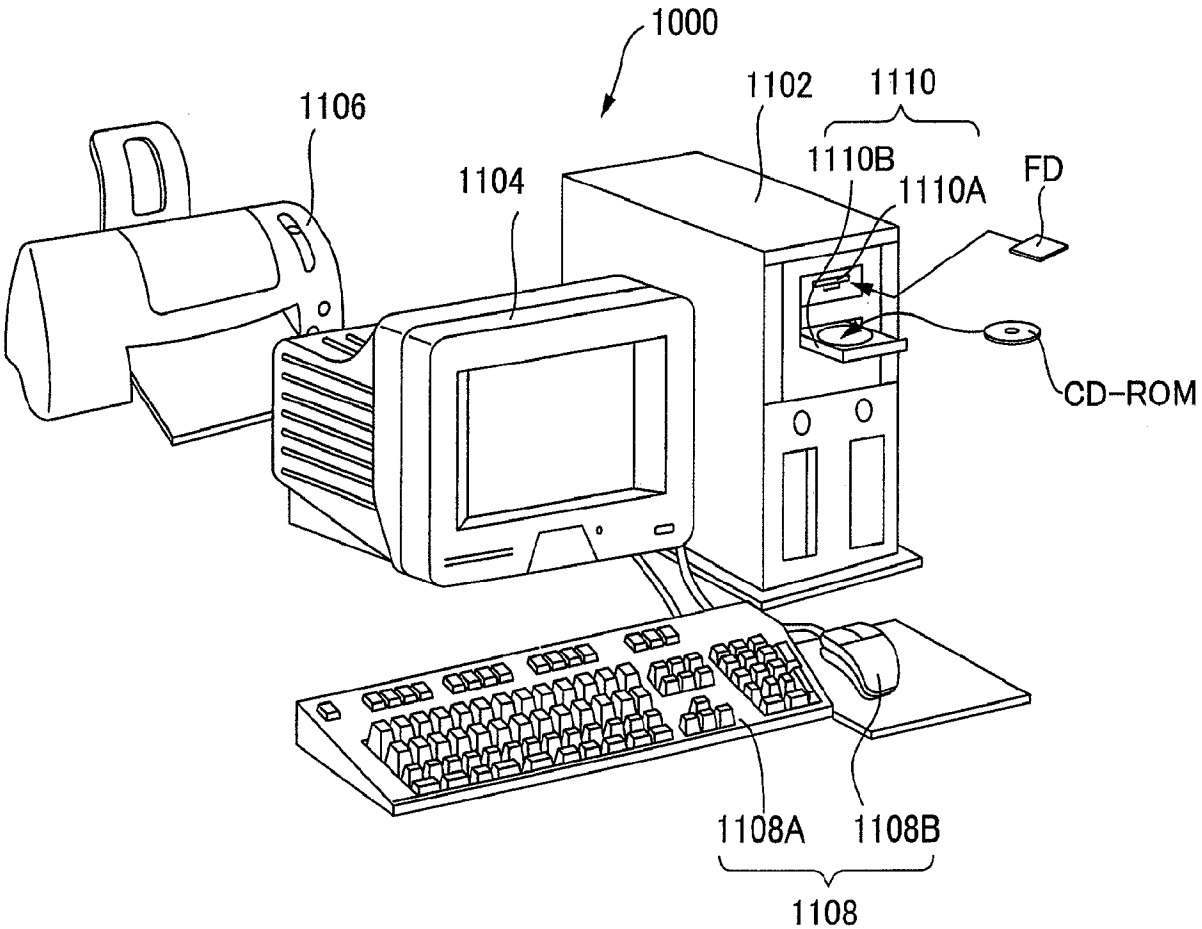
FIG. 14 is an explanatory drawing showing the external structure of a computer system.

FIG. 14 is an explanatory drawing showing the external structure of a computer system. A computer system 1000 is provided with a main computer unit 1102, a display device 1104, a printer 1106, input devices 1108, and reading devices 1110. In this embodiment, the main computer unit 1102 is accommodated within a mini-tower type housing; however, there is no limitation to this. A CRT (cathode ray tube), plasma display, or liquid crystal display device, for example, is generally used as the display device 1104, but there is no limitation to this. The printer 1106 is the printer described above. In this embodiment, the input devices 1108 are a keyboard 1108A and a mouse 1108B, but there is no limitation to these. In this embodiment, a flexible disk drive device 1110A and a CD-ROM drive device 1110B are used as the reading devices 1110, but the reading devices 1110 are not limited to these, and may also be a MO (magneto optical) disk drive device or a DVD (digital versatile disk), for example.

Figure 15:
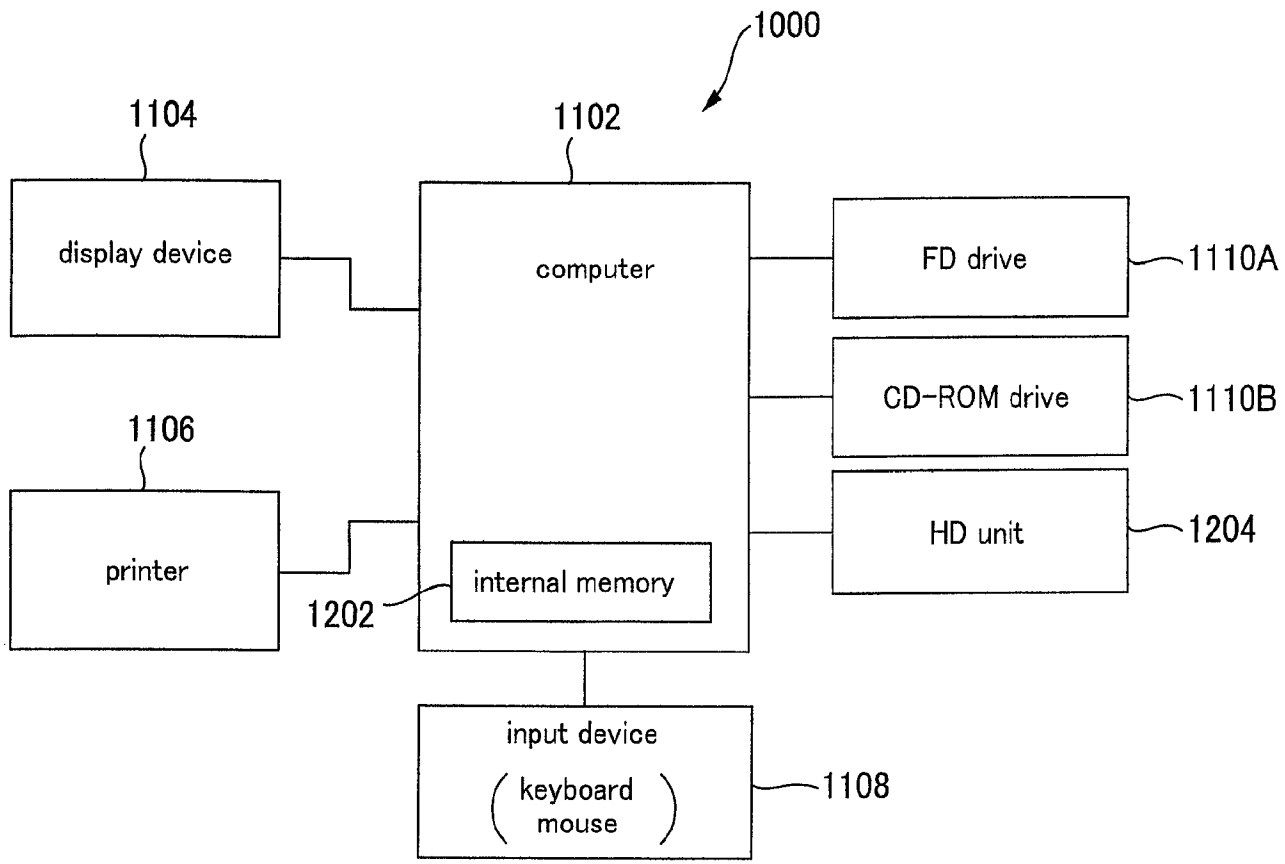
FIG. 15 is a block diagram showing a configuration of the computer system shown in FIG. 14.
Figure 16:
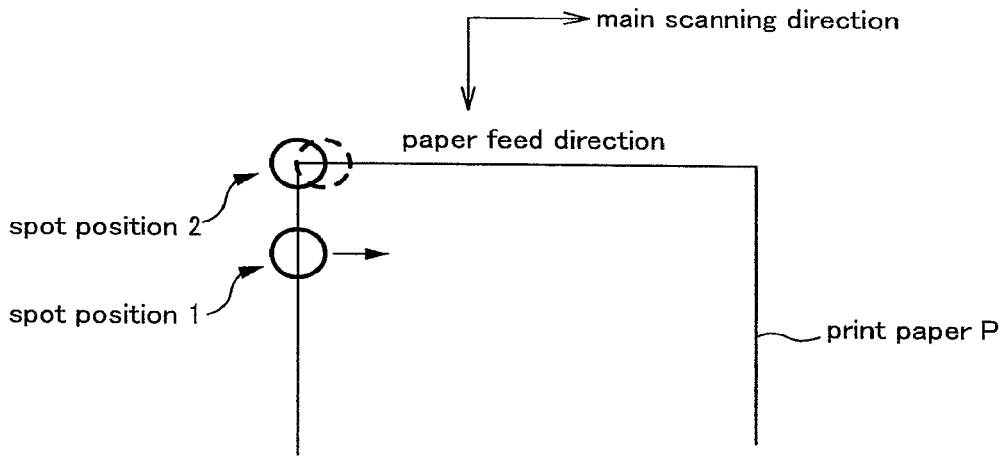
FIG. 16 is a schematic diagram showing the positional relationship between the print paper P and an illumination spot of the left-and-right-edge detection sensor on the print paper P.
Figure 17:
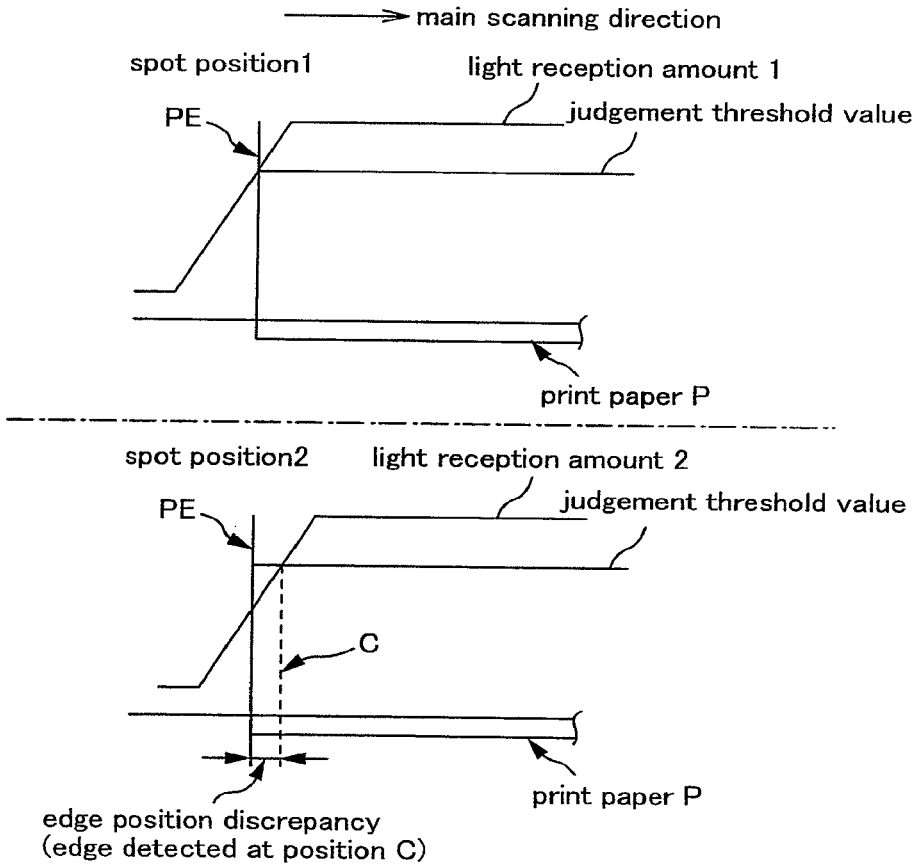
FIG. 17 is an explanatory drawing illustrating the shift in left/right edge detection depending on the position of the illumination spot of the left-and-right-edge detection sensor on the print paper P.

FIG. 15 is a block diagram showing a configuration of the computer system shown in FIG. 14. An internal memory 1202 such as a RAM is provided within the housing accommodating the main computer unit 1102, and also an external memory such as a hard disk drive unit 1204 is provided.

In the above description, an example was described in which the computer system is constituted by connecting the printer 1106 to the main computer unit 1102, the display device 1104, the input devices 1108, and the reading devices 1110; however, there is no limitation to this. For example, the computer system can be made of the main computer unit 1102 and the printer 1106, and the computer system does not have to be provided with all of the display device 1104, the input device 1108, and the reading device 1110.

It is also possible for the printer 1106 to have some of the functions or mechanisms of the main computer unit 1102, the display device 1104, the input devices 1108, and the reading devices 1110. As an example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

As an overall system, the computer system that is thus achieved is superior to conventional systems.

INDUSTRIAL APPLICABILITY

According to the present invention, it is possible to achieve a liquid ejection apparatus, a liquid ejection system, and a liquid ejection method that allow starting and ending positions for ejection of liquid to be set appropriately.

What is claimed is:

1. A liquid ejection apparatus for ejecting liquid, comprising:

an ejection head that moves along a main scanning direction and ejects liquid;

a feed mechanism that feeds a medium along a feeding direction;

a sensor that detects a position of an edge of the medium in the main scanning direction; and a controller that controls an ejecting area of the liquid in the main scanning direction according to the position of the edge of the medium, and make the ejection head eject liquid with respect to an entire surface of the medium, wherein with respect to a middle area of the medium in the feeding direction, the controller repeats making the sensor detect the position of the edge, and making the ejecting head eject liquid according to the detected position of the edge, and wherein with respect to a rear area which is within a predetermined distance from a rear edge of the medium in the feeding direction, the controller does not make the sensor detect the position of the edge, and makes the ejecting head eject liquid according to the position of the edge which has been detected in the middle area.

2. A liquid ejection apparatus according to claim 1, wherein:

the predetermined distance is determined based on an amount by which the medium is fed taking the rear edge in the feeding direction as a reference.

3. A liquid ejection apparatus according to claim 1, the predetermined distance is determined based on an amount by which the medium is fed taking a front edge in the feeding direction as a reference.

4. A liquid ejection method for ejecting liquid, comprising:

preparing an ejection head that moves along a main scanning direction and ejects liquid;

preparing a feed mechanism that feeds a medium along a feeding direction;

preparing a sensor that detects a position of an edge of the medium in the main scanning direction; and preparing a controller that controls an ejecting area of the liquid in the main scanning direction according to the position of the edge of the medium, and make the ejection head eject liquid with respect to an entire surface of the medium, wherein with respect to a middle area of the medium in the feeding direction, causing the controller to repeat making the sensor detect the position of the edge, and making the ejecting head eject liquid according to the detected position of the edge, and wherein with respect to a rear area which is within a predetermined distance from a rear edge of the medium in the feeding direction, causing the controller not to make the sensor detect the position of the edge, and to make the ejecting head eject liquid according to the position of the edge which has been detected in the middle area.

5. A liquid ejection method according to claim 4, wherein:

the predetermined distance is determined based on an amount by which the medium is fed taking the rear edge in the feeding direction as a reference.

6. A liquid ejection method according to claim 4, the predetermined distance is determined based on an amount by which the medium is fed taking a front edge in the feeding direction as a reference.

7. A liquid ejection apparatus for ejecting liquid, comprising:

an ejection head that moves along a main scanning direction and ejects liquid;

a feed mechanism that feeds a medium along a feeding direction;

a sensor that detects a position of an edge of the medium in the main scanning direction; and a controller that controls an ejecting area of the liquid in the main scanning direction according to the position of the edge of the medium, and make the ejection head eject liquid with respect to an entire surface of the medium, wherein with respect to a middle area of the medium in the feeding direction, the controller repeats making the sensor detect the position of the edge, and making the ejecting head eject liquid according to the detected position of the edge, and wherein with respect to a rear area which is within a predetermined distance from a rear edge of the medium in the feeding direction, the controller makes the sensor detect the position of the edge, and makes the ejecting head eject liquid not according to the detected position of the edge in the rear area but according to the position of the edge which has been detected in the middle area.

8. A liquid ejection apparatus according to claim 7, wherein:

the predetermined distance is determined based on an amount by which the medium is fed taking the rear edge in the feeding direction as a reference.

9. A liquid ejection apparatus according to claim 7, wherein:

the predetermined distance is determined based on an amount by which the medium is fed taking a front edge in the feeding direction as a reference.

10. A liquid ejection method for ejecting liquid, comprising:

preparing an ejection head that moves along a main scanning direction and ejects liquid;

preparing a feed mechanism that feeds a medium along a feeding direction;

preparing a sensor that detects a position of an edge of the medium in the main scanning direction; and preparing a controller that controls an ejecting area of the liquid in the main scanning direction according to the position of the edge of the medium, and make the ejection head eject liquid with respect to an entire surface of the medium, wherein with respect to a middle area of the medium in the feeding direction, causing the controller to repeat making the sensor detect the position of the edge, and making the ejecting head eject liquid according to the detected position of the edge, and wherein with respect to a rear area which is within a predetermined distance from a rear edge of the medium in the feeding direction, causing the controller to make the sensor detect the position of the edge, and to make the ejecting head eject liquid not according to the detected position of the edge in the rear area but according to the position of the edge which has been detected in the middle area.

11. A liquid ejection method according to claim 10, wherein:

the predetermined distance is determined based on an amount by which the medium is fed taking the rear edge in the feeding direction as a reference.

12. A liquid ejection method according to claim 10, the predetermined distance is determined based on an amount by which the medium is fed taking a front edge in the feeding direction as a reference.

* * * * *